US006879097B2

(12) United States Patent
Dunphy

(10) Patent No.: US 6,879,097 B2
(45) Date of Patent: Apr. 12, 2005

(54) FLAT-PANEL DISPLAY CONTAINING ELECTRON-EMISSIVE REGIONS OF NON-UNIFORM SPACING OR/AND MULTI-PART LATERAL CONFIGURATION

(75) Inventor: James C. Dunphy, San Jose, CA (US)

(73) Assignees: Candescent Technologies Corporation, Los Gatos, CA (US); Candescent Intellectual Property Services, Inc., Los Gatos, CA (US)

( * ) Notice: Subject to any disclaimer, the term of this patent is extended or adjusted under 35 U.S.C. 154(b) by 190 days.

(21) Appl. No.: 09/967,728

(22) Filed: Sep. 28, 2001

(65) Prior Publication Data

US 2003/0062823 A1 Apr. 3, 2003

(51) Int. Cl.[7] ..... H01J 1/62; H01J 63/04; H01J 1/02

(52) U.S. Cl. ..... 313/495; 313/496; 313/497; 313/309; 313/310; 313/573

(58) Field of Search ..... 313/495, 496, 313/497, 309, 310, 573, 351

(56) References Cited

U.S. PATENT DOCUMENTS

| | | | | |
|---|---|---|---|---|
| 5,374,868 A | | 12/1994 | Tjaden et al. | 313/310 |
| 5,543,683 A | | 8/1996 | Haven et al. | 313/461 |
| 5,569,975 A | | 10/1996 | Taylor et al. | 313/310 |
| 5,574,333 A | | 11/1996 | Clerc | 313/497 |
| 5,589,728 A | | 12/1996 | Levine et al. | 313/336 |
| 5,621,272 A | | 4/1997 | Levine et al. | 313/422 |
| 5,631,518 A | | 5/1997 | Barker | 313/308 |
| 5,650,690 A | | 7/1997 | Haven | 313/422 |
| 5,672,933 A | | 9/1997 | Wilson et al. | 313/336 |
| 5,686,782 A | | 11/1997 | Hecker, Jr. et al. | 313/309 |
| 5,838,097 A | * | 11/1998 | Kasanuki et al. | 313/495 |
| 5,859,502 A | | 1/1999 | Spindt et al. | 315/169.3 |
| 5,898,266 A | | 4/1999 | Spindt et al. | 313/495 |
| 5,990,614 A | | 11/1999 | Spindt | 313/495 |
| 5,998,923 A | | 12/1999 | Jager | 313/495 |
| 6,002,199 A | | 12/1999 | Spindt et al. | 313/309 |
| 6,013,974 A | | 1/2000 | Haven et al. | 313/309 |
| 6,049,165 A | | 4/2000 | Spindt et al. | 313/495 |
| 6,064,157 A | | 5/2000 | Spindt et al. | 315/169.3 |
| 6,107,728 A | | 8/2000 | Spindt et al. | 313/310 |
| 6,107,731 A | | 8/2000 | Spindt et al. | 313/495 |
| 6,242,865 B1 | * | 6/2001 | Zimlich | 315/169.3 |
| 6,320,310 B1 | * | 11/2001 | Imai et al. | 313/497 |
| 6,437,503 B1 | * | 8/2002 | Konuma | 313/495 |
| 6,472,813 B2 | * | 10/2002 | Mitsutake et al. | 313/495 |

FOREIGN PATENT DOCUMENTS

| | | |
|---|---|---|
| WO | WO 00/02081 | 1/2000 |

* cited by examiner

*Primary Examiner*—Ashok Patel
*Assistant Examiner*—Matt Hodges
(74) *Attorney, Agent, or Firm*—Ronald J. Meetin

(57) ABSTRACT

A flat-panel cathode-ray tube display contains electron-emissive regions (54) spaced non-uniformly apart from one another in a line of the electron-emissive regions so as to better utilize the space where the electron-emissive regions are located. Alternatively or additionally, electron focusing can be appropriately made more concentrated by implementing each electron-emissive region as two or more portions 54A–54F) situated suitably with respect to openings (86A–86F) in an electron-focusing system (76).

66 Claims, 13 Drawing Sheets

FLAT-PANEL DISPLAY CONTAINING ELECTRON-EMISSIVE REGIONS OF NON-UNIFORM SPACING OR/AND MULTI-PART LATERAL CONFIGURATION

FIELD OF USE

This invention relates to flat-panel displays of the cathode-ray-tube ("CRT") type.

BACKGROUND

A flat-panel CRT display basically consists of an electron-emitting device and a light-emitting device. Electrons emitted by the electron-emitting device, commonly referred to as a cathode, strike the light-emitting device and cause it to emit light that produces an image on the viewing surface of the display.

FIG. 1 presents a side cross section of part of the active imaging region of a conventional flat-panel CRT display such as that described in U.S. Pat. No. 6,049,165. Electron-emitting device 10 of this conventional display is coupled to light-emitting device 12 through an outer wall (not visible here) to form sealed enclosure 14 maintained at a low internal pressure e.g., $10^{-6}$ torr. A spacer system is situated inside enclosure 14 for maintaining a relatively uniform separation between devices 10 and 12 and for preventing the external-to-internal pressure differential of approximately 1 atm. from the collapsing the display. The spacer system consists of generally parallel spacer walls 16, one of which is shown in FIG. 1.

FIG. 2 illustrates the layout of electron-emitting device 10 as seen along a plane extending laterally through sealed enclosure 14. Device 10 consists of backplate 20 and a group of layers/regions situated on the interior surface of backplate 20. The layers/regions include an array of equally spaced rows and equally spaced columns of electron-emissive regions 22. The layers/regions also include electron-focusing system 24 having openings 26 through which electron-emissive regions 22 are exposed to enclosure 14. Item 28 in FIG. 1 represents the trajectory of an electron which is emitted by one of regions 22 and which travels through overlying focus opening 26 to light-emitting device 12.

Light-emitting device 12 consists of transparent faceplate 30, an array of equally spaced rows and equally spaced columns of light-emissive regions 32, black matrix 34, and light-reflective anode layer 36 arranged as shown in FIG. 1. Each light-emissive region 32 is situated directly opposite a corresponding different one of electron-emissive regions 22. Upon being selectively struck by electrons emitted by regions 22, light-emissive regions 32 emit light to produce an image on the exterior surface of faceplate 30 at the front of the display.

As indicated in FIGS. 1 and 2, each spacer wall 16 contacts electron-focusing system 24 along a location above the space between a pair of consecutive rows of electron-emissive regions 22. Although spacer walls 16 maintain a relatively uniform spacing between devices 10 and 12, the presence of walls 16 restrict the dimensions of electron-emissive regions 22 in the direction of the columns of regions 22, i.e., in the direction perpendicular to walls 16. It would be desirable to configure a flat-panel CRT display in such a manner that the presence of spacer walls places less restriction on the lateral dimensions of electron-emissive regions in the direction perpendicular to the spacer walls.

GENERAL DISCLOSURE OF THE INVENTION

The present invention furnishes a flat-panel CRT display in which a group of electron-emissive regions situated in a line are non-uniformly spaced apart from one another so as to provide better utilization of the space where the electron-emissive regions are located. A spacer, typically a spacer wall, can readily be positioned above the space between one pair of consecutive electron-emissive regions whose separation is greater than the separation between another pair of consecutive electron-emissive regions. Due to the non-uniform spacing of the electron-emissive regions, the presence of such a spacer wall places less restriction on the dimensions of the electron-emissive regions in the direction perpendicular to the spacer wall than would occur if the electron-emissive regions were spaced uniformly apart from one another in that direction. The lateral dimensions of the electron-emissive regions in the present flat-panel display can thereby be made greater in the direction perpendicular to the spacer wall than could otherwise reasonably be achieved.

More particularly, a flat-panel CRT display having improved space utilization in accordance with the invention contains an electron-emitting device and a light-emitting device which together act to produce an image. The electron-emitting device has at least three laterally separated electron-emissive regions arranged in a line extending in a main direction. Each pair of consecutive electron-emissive regions in the line is at a center-to-center spacing which is at least 3% greater in the main direction for one pair of consecutive electron-emissive regions than for another pair of consecutive electron-emissive regions. A spacer, e.g., a spacer wall, is typically situated between the electron-emitting and light-emitting devices above the space between a pair of consecutive electron-emissive regions whose center-to-center spacing is at least 3% greater in the main direction than that of another pair of consecutive electron-emissive regions.

The light-emitting device similarly has at least three light-emissive regions arranged in a line extending in the main direction. Each light-emissive region is situated generally opposite a corresponding different one of the electron-emissive regions. Upon being struck by electrons emitted by one of the electron-emissive regions, the corresponding oppositely situated light-emissive region emits light to produce at least part of a dot of the display's image. In contrast to the electron-emissive regions, the light-emissive regions are normally of approximately uniform center-to-center spacing in the main direction. Consequently, certain of the light-emissive regions are slightly laterally offset from the corresponding electron-emissive regions in the main direction.

The present flat-panel display normally includes a system for focusing electrons emitted by each electron-emissive region on the corresponding light-emissive region. The electron-focusing system has at least three focus openings arranged in a line extending generally in the main direction. Each focus opening is located at least partially, typically substantially fully, above a corresponding different one of the electron-emissive regions so that electrons emitted by each electron-emissive region pass at least partially, typically substantially fully, through the corresponding focus opening. In focusing the electrons emitted by the electron-emissive regions respectively on the corresponding light-emissive regions, the electron-focusing system appropriately compensates for any lateral offset of certain of the light-emissive regions to the corresponding electron-emissive regions in the main direction. This compensation is typically achieved by arranging for each electron-emissive region and the corresponding focus opening to be at a suitable non-zero center-to-center spacing in the main direction.

The electron-emissive regions are preferably allocated into alternating first and second pairs of consecutive electron-emissive regions for which each second pair of consecutive electron-emissive regions is at a greater, normally at least 3% greater, center-to-center spacing in the main direction than each first pair of consecutive electron-emissive regions. A spacer, e.g., again a spacer wall, is typically situated between the electron-emitting and light-emitting devices above the space between one of the second, more widely separated, pairs of consecutive electron-emissive regions. For the normal case in which the light-emissive regions are uniformly spaced apart in the main direction, the present display utilizes the electron-focusing system to compensate for the resultant lateral offset of the light-emissive regions to the electron-emissive regions.

Each electron-emissive region may be divided into two or more electron-emissive portions laterally separated in the main direction. In that case, the focus opening corresponding to each electron-emissive region is replaced with two or more focus openings, each located at least partially above a corresponding different one of the electron-emissive portions of that electron-emissive region. The compensation for the lateral offset of certain light-emissive regions to the corresponding electron-emissive regions in the main direction is then achieved by arranging for the composite center of the electron-emissive portions of each of certain of the electron-emissive regions to be appropriately laterally separated in the main direction from the composite center of the focus openings above those electron-emissive portions.

The present invention also furnishes a flat-panel CRT display having highly concentrated electron focusing. In particular, this further display is designed so that electrons emitted by an electron-emissive region of the display's electron-emitting device converge generally on a narrow location in an oppositely situated light-emissive region of the display's light-emitting device. The concentrated electron focusing enables the average distance between the electron-emitting and light-emitting devices to be increased, thereby permitting the voltage applied to an anode in the electron-emitting device to be made higher relative to the average voltage applied to the electron-emissive region. Increasing the anode voltage, in turn, enables the display to operate more efficiently and results in longer display life. Alternatively or additionally, the average electric field in the space between the electron-emitting and light-emitting devices can be reduced so as to improve display reliability and decrease the likelihood of electrical arcing.

The electron-emissive region in the display with concentrated electron focusing is divided into a pair of laterally separated electron-emissive portions. Electrons emitted by the electron-emissive portions pass respectively at least partially through a pair of at least partially overlying focus openings in an electron-focusing system of the electron-emitting device. The concentrated electron focusing is achieved by arranging for the two electron-emissive portions of the electron-emissive region to be at a greater lateral center-to-center spacing than the two focus openings. With one or more suitable voltages applied to the electron-focusing system, configuring the focus openings in this manner relative to the electron-emissive portions enables the electron-focusing system to act like a convergent lens. After passing through the focus openings, the electrons emitted by the electron-emissive portions thus converge generally on a line of the light-emissive region.

The configuration feature which enables space in the electron-emitting device to be used more efficiently can be combined with the electron-focusing concentration feature. In a typical implementation, electron-emissive regions situated in a line are non-uniformly spaced apart from one another in one direction in order to improve the space utilization while each electron-emissive region is divided into a pair of electron-emissive portions laterally separated from each other in another direction largely perpendicular to the first-mentioned direction. With all the electron-emissive portions being exposed through respective overlying openings in an electron-focusing system, the two electron-emissive portions of each electron-emissive region are at a greater center-to-center spacing than the two overlying focus openings so as to achieve concentrated electron focusing. In short, the invention provides substantial advantages over conventionally organized flat-panel CRT displays.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

General Considerations

Figure 1:
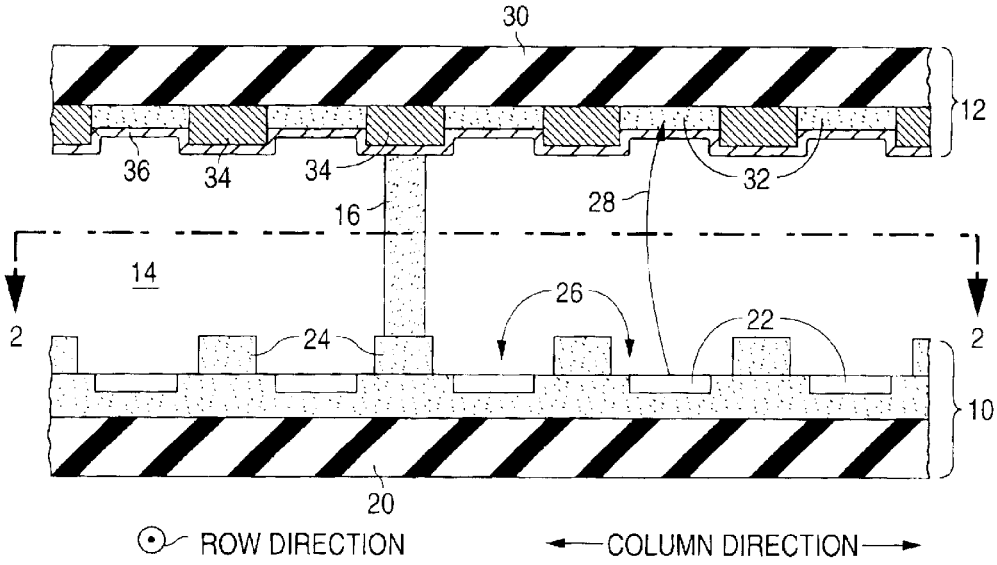
Fig. 1 PRIOR ART
FIG. 1 is a cross-sectional side view of part of the active region of a conventional flat-panel CRT display.

Various structures are described below for a flat-panel CRT display configured according to the invention to enhance space utilization in the display's electron-emitting device or/and achieve concentrated electron focusing. Each of the present flat-panel CRT displays, typically of the field-emission type, is generally suitable for a flat-panel television or a flat-panel video monitor for a personal computer, a laptop computer, a workstation, or a hand-held device such as a personal digital assistant.

The electron-emitting device in each of the present flat-panel CRT displays contains a two-dimensional array of electron-emissive regions arranged in rows and columns. The display's light-emitting device similarly contains a two-dimensional array of light-emissive regions arranged in rows and columns. Each light-emissive region is situated generally opposite a corresponding one of the electron-emissive regions.

A flat-panel CRT display produces its image in an active region of the display. The active region consists of an active light-emitting portion of the light-emitting device, an active electron-emitting portion of the electron-emitting device, and the space between the active light-emitting and electron-emitting portions. The active light-emitting portion extends from the first row of light-emissive regions to the last row of light-emissive regions and from the first column of light-emissive regions to the last column of light-emissive regions. The active electron-emitting portion similarly extends from the first row of electron-emissive regions to the last row of electron-emissive regions and from the first column of electron-emissive regions to the last column of electron-emissive regions.

Each of the present flat-panel displays is typically a color display but can be a monochrome, e.g., black-and-green or black-and-white, display. Each light-emissive region and the corresponding oppositely situated electron-emissive region form a pixel in a monochrome display, and a sub-pixel in a color display. A color pixel typically consists of three sub-pixels, one for red light, another for green light, and the third for blue light. Each pixel, whether color or monochrome, provides a dot of the image produced by the display. A subpixel in a color display thus provides part of a dot of the display's image.

The electron-emitting device in each of the present flat-panel displays contains a group of control electrodes for controlling the magnitudes of the electron currents travelling to the oppositely situated light-emitting device. When the electron-emitting device operates according to field (cold) emission, the control electrodes extract electrons from the electron-emissive elements. An anode in the light-emitting device attracts the extracted electrons toward the light-emissive regions.

When the electron-emitting device contains electron-emissive elements which continuously emit electrons during display operation, e.g., by thermal emission, the control electrodes selectively pass the emitted electrons. That is, as electrons are emitted under conditions which, in the absence of the control electrodes, would enable those electrons to go past the locations of the control electrodes. The control electrodes permit certain of those electrons to pass the control electrodes and collect the remainder of those electrons or otherwise prevent the remaining electrons from passing the control electrodes. The anode in the light-emitting device attracts the passed electrons toward the light-emissive regions.

In the following description, the term "electrically insulating" or "dielectric" generally applies to materials having a resistivity greater than $10^{10}$ ohm-cm at 25° C. The term "electrically non-insulating" or "non-dielectric" thus refers to materials having a resistivity of no more than $10^{10}$ ohm-cm at 25° C. Electrically non-insulating or non-dielectric materials are divided into (a) electrically conductive materials for which the resistivity is less than 1 ohm-cm and (b) electrically resistive materials for which the resistivity is in the range of 1 ohm-cm to $10^{10}$ ohm-cm at 25° C. Similarly, the term "electrically non-conductive" refers to materials having a resistivity of at least 1 ohm-cm, and includes electrically resistive and electrically insulating materials. These categories are determined at an electric field of no more than 10 volts/$\mu$m.

Figure 3:
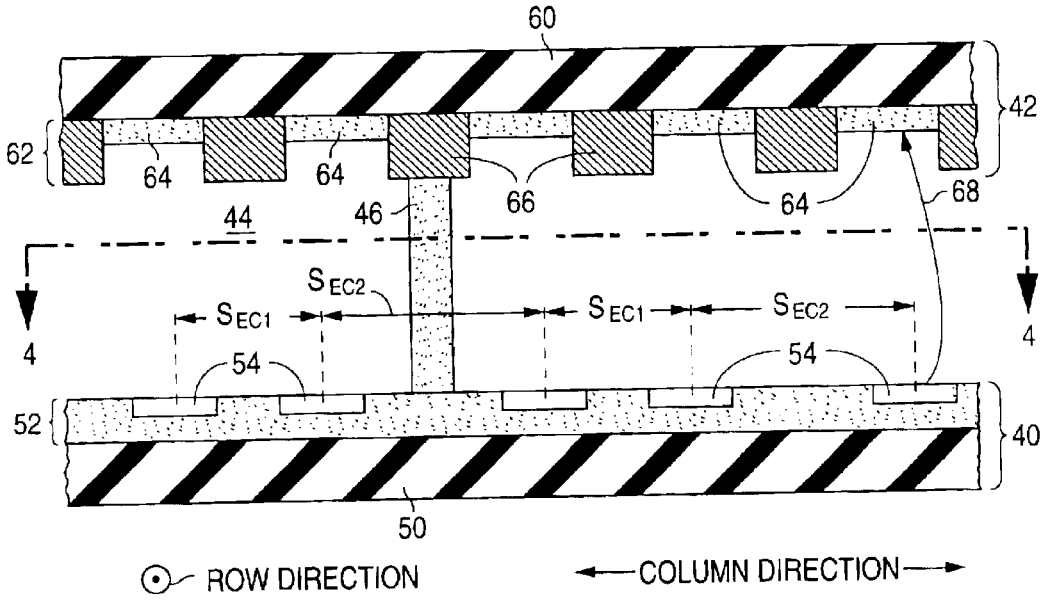
FIG. 3 is a cross-sectional side view of part of the active region of a flat-panel CRT display having rows of electron-emissive regions spaced non-uniformly apart from one another according to the invention.
Figure 4:
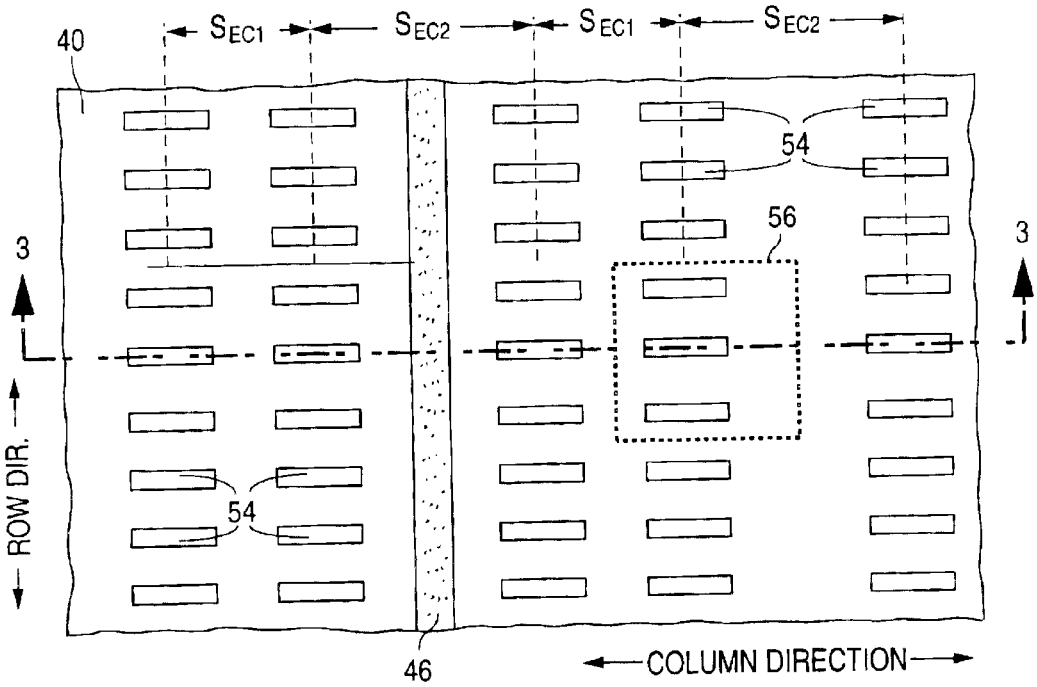
FIG. 4 is a cross-sectional plan view of part of the active region of the flat-panel display, specifically the electron-emitting device, of FIG. 3. The cross section of FIG. 3 is taken through plane 3—3 in FIG. 4. The cross section of FIG. 4 is taken through plane 4—4 in FIG. 3.

Flat-Panel Display Having Line of Non-uniformly Spaced Electron-Emitting Regions FIGS. 3 and 4 respectively illustrate side and plan-view (layout) cross sections of part of the active region of a general flat-panel CRT display in which electron-emitting regions situated in a line extending in a main direction are spaced non-uniformly apart from one another in accordance with the invention so as to achieve improved space utilization. The flat-panel display of FIGS. 3 and 4 contains an electron-emitting device 40 and an oppositely situated light-emitting device 42. Devices 40 and 42 are connected together through an outer wall (not visible here) to form a sealed enclosure 44 maintained at a high vacuum, typically an internal pressure of no more than approximately $10^{-6}$ torr. The plan-view cross section of FIG. 4 is taken in the direction of electron-emitting device 40 along a plane extending laterally through enclosure 44. Accordingly, FIG. 4 largely presents a plan view of part of the active portion of device 40.

A spacer system is situated between devices 40 and 42 inside enclosure 44 for resisting external forces exerted on the flat-panel display and for maintaining a relatively uniform separation between devices 40 and 42. In particular, the spacer system prevents the external-to-internal pressure difference of approximately 1 atm. from collapsing the display. The spacer system here consists of a group of spacer walls 46 extending general parallel to one another in a direction referred to here as the row direction. One such spacer wall 46 is indicated in FIGS. 3 and 4.

Each of spacer walls 46 normally consists of a main wall (not separately shown) and one or more electrodes (also not separately shown) situated over the main wall. For instance, each spacer wall 46 may contact devices 40 and 42 through a pair of respective edge electrodes situated over opposite edges of that spacer's main wall. Face electrodes may overlie the face (side) surfaces of the main walls for controlling the trajectories of electrons moving from electron-emitting device 40 to light-emitting device 42. Exemplary configurations for spacer walls 46 are presented in U.S. Pat. Nos. 5,990,614, 6,049,165, and 6,107,731.

Electron-emitting device, or backplate structure, 40 is formed with a generally flat electrically insulating backplate 50 and a group of layers and regions 52 situated over the interior surface of backplate 50. Layers/regions 52 include a two-dimensional array of rows and columns of laterally separated electron-emissive regions 54. The rows of electron-emissive regions 54 are largely straight and extend laterally in the row direction. The columns of regions 54 are likewise largely straight and extend laterally perpendicular to the row direction in a direction referred to here as the column direction. The number of columns of regions 54 is at least three and is normally considerably greater than three. The same applies to the number of rows of regions 54. Each region 54 consists of one or more electron-emissive elements (not separately shown here) which emit electrons directed toward light-emitting device 42.

The spacings between consecutive rows of electron-emissive regions 54 are non-uniform in the flat-panel display of FIGS. 3 and 4. The rows of regions 54 are allocated into alternating first and second pairs of consecutive rows of regions 54. In other words, the second pairs of consecutive rows of regions 54 alternate with the first pairs of consecutive rows of regions 54. One such first pair of consecutive rows of regions 54 is formed by the first and second rows of regions 54 starting from the left-hand side of FIG. 4. One such second pair of rows of regions 54 is formed by the second and third rows of regions 54 starting from the left-hand side of FIG. 4. The distance between each second pair of consecutive rows of regions 54 is, in accordance with the invention, significantly greater than the distance between each first pair of consecutive rows of regions 54.

More particularly, the center of a row of electron-emissive regions 54 is a line that extends in the row direction and goes through the centers of regions 54 in that row. The center-to-center spacing between each first pair of consecutive rows of regions 54 is largely the same for all the first pairs of consecutive rows of regions 54. The center-to-center spacing between each second pair of consecutive rows of regions 54 is likewise largely the same for all the second pairs of consecutive rows of regions 54. Let $S_{EC1}$ represent the (average) center-to-center spacing between each first pair of consecutive rows of regions 54. Similarly let $S_{EC2}$ represent the (average) center-to-center spacing between each second pair of consecutive rows of regions 54. Center-to-center spacing $S_{EC2}$ of the second pairs of consecutive rows of regions 54 is normally at least 3% greater than, preferably at least 5% greater than, more preferably at least 10% greater than, and even more preferably at least 20% greater than, center-to-center spacing $S_{EC1}$ of the first pairs of consecutive rows of regions 54.

Alternatively stated, each column of electron-emissive regions 54 in the display of FIGS. 3 and 4 forms a line extending in a main direction consisting of the column direction, regions 54 in that line being non-uniformly spaced apart from one another. With regions 54 in each column being allocated into alternating first and second pairs of consecutive regions 54, the center-to-center spacing between each first pair of consecutive regions 54 in each column is essentially spacing $S_{EC1}$ and is largely the same for all the first pairs of consecutive regions 54 in that column. The center-to-center spacing between each second pair of consecutive regions 54 in each column is likewise essentially spacing $S_{EC2}$ and is largely the same for all the second pairs of consecutive regions 54 in that column. Center-to-center spacing $S_{EC2}$ between each second pair of consecutive regions 54 in the column direction is then normally at least 3% greater than, preferably at least 5% greater than, more preferably at least 10% greater than, and even more preferably at least 20% greater than, center-to-center spacing $S_{EC1}$ between each first pair of consecutive regions 54 in the column direction.

Electron-emissive regions 54 can be configured laterally in various ways. Regions 54 are typically of largely the same size, of largely the same orientation, and are largely laterally symmetrical about their centerlines (not shown) in the row direction. FIG. 4 depicts an example in which regions 54 are shaped laterally generally as rectangles of considerably greater dimension in the column direction than in the row direction.

More generally, electron-emissive regions 54 are configured so that (as viewed perpendicular to backplate 50) regions 54 in each row are largely mirror images, relative to the row direction, of regions 54 in each directly adjacent row. In other words, regions 54 in alternating rows are largely mirror images, relative to the row direction, of regions 54 in the remaining alternating rows. The layout of FIG. 4 is the limiting case of this alternating mirror-image arrangement in which each region 54 is laterally symmetrical about its centerline in the row direction.

A pixel, whether color or monochrome, is typically largely square as seen from the front of a flat-panel display.

The display of FIGS. 3 and 4 is specifically a color display in which three of electron-emissive regions 54 in a row form the electron-emissive section of a color pixel. Dotted line 56 in FIG. 4 indicates the lateral boundary of the electron-emitting section of one color pixel. Because each color pixel is largely square, each exemplary region 54 in this color display is of considerably greater dimension in the column direction than in the row direction.

Electron-emissive regions 54 are spaced largely uniformly apart from one another in the row direction in the display of FIGS. 3 and 4. That is, the center-to-center spacings between consecutive columns of regions 54 are largely the same.

Each spacer wall 46 is located above (part of) the space between one of the second pairs of consecutive rows of electron-emissive regions 54, i.e., above the space between a pair of the more widely separated rows of regions 54. In particular, each spacer wall 46 is preferably equidistant from the two nearest rows of regions 54 on opposite sides of that wall 46. From a column perspective, each wall 46 is located above the space between, and preferably centered on that space between, one of the second pairs of consecutive regions 54 in each column.

There are normally considerably less spacer walls 46 than second pairs of consecutive rows of electron-emissive regions 54. Hence, no walls 46 are normally located over the spaces between many of the second pairs of consecutive rows of regions 54. There is normally only one wall 46 for every 30–40 rows of regions 54. Walls 46 are also normally distributed approximately uniformly across the active region of the display. Accordingly, one wall 46 is located above the space between every fifteenth to twentieth pair of consecutive rows of regions 54.

Several benefits arise from locating each spacer wall above the space between one of the second pairs of consecutive rows of electron-emissive regions 54. Firstly, more dimensional tolerance in appropriately positioning spacer walls 46 on electron-emitting device 40 is available when they are positioned over the spaces between the more widely separated pairs of consecutive rows of regions 54 than what would occur if the rows of regions 54 were spaced uniformly apart. Slight deviations from the desired target positions of walls 46 can be better tolerated in the display of FIGS. 3 and 4.

Secondly, the presence of spacer walls 46 constrains the dimensions of electron-emissive regions 54 in the column direction, i.e., in the direction perpendicular to walls 46. By configuring the rows of regions 54 as alternating more widely separated and more narrowly separated pairs of consecutive rows of regions 54 and placing each spacer wall 46 over the space between a pair of more widely separated consecutive rows of regions 54, less constraint is placed on the dimensions of regions 54 in the column direction than would arise if consecutive rows of regions 54 were uniformly spaced apart. For a given lateral area of the active display region and a given number of rows of regions 54, the dimensions of regions 54 can be increased in the column direction, thereby yielding a more robust display. The voltages needed to switch regions 54 can also be reduced somewhat.

Thirdly, spacer walls 46 invariably disturb the trajectories of electrons traveling from electron-emissive regions 54 to light-emitting device 42. The disturbance that each spacer wall 46 produces on the electron trajectories is normally greatest on the trajectories of the electrons emitted by regions 54 in the two nearest rows of regions 54 on opposite sides of that wall 46, i.e., on the trajectories of electrons traveling closest to that wall 46. Compared to what would happen if regions 54 were spaced uniformly apart from one another, positioning walls 46 above the locations between more widely separated pairs of consecutive rows of regions 54 increases the average distance from each region 54 to the nearest electrons traveling from electron-emitting device 40 to light-emitting device 42. Consequently, less disturbance of the electron trajectories is caused by walls 46 in the display of FIGS. 3 and 4 than is caused by the spacer walls in an otherwise identical conventional flat-panel CRT display such as that of FIGS. 1 and 2. Resultant difficulties, such as spacer wall visibility on the display's viewing surface, are reduced in the display of FIGS. 3 and 4.

Light-emitting device, or faceplate structure, 42 is formed with a generally flat electrically insulating faceplate 60 and a group of layers and regions 62 situated on the interior surface of faceplate 60. Faceplate 60 is transparent, i.e., generally transmissive of visible light, at least where visible light is intended to pass through faceplate 60 to produce an image on the exterior surface (upper surface in FIG. 3) of faceplate 60 at the front of the display. Layers/regions 62 include a two-dimensional array of laterally separated largely identical light-emissive regions 64, a patterned black matrix 66, and an anode (not separately shown here). There are at least three, and normally considerably greater than three, rows or columns of light-emissive regions 64.

Light-emissive regions 64 emit light upon being struck by electrons. Each region 64 is situated generally opposite a corresponding different one of electron-emissive regions 54. The electrons emitted by each region 54 are thereby intended to strike corresponding light-emissive region 64 to produce suitable light.

The rows of light-emissive regions 64 are largely straight and extend in the row direction. The columns of regions 64 are likewise largely straight and extend in the column direction. In the display of FIGS. 3 and 4, three consecutive regions 64 in a row respectively emit red, green, and blue light when struck by electrons emitted from three corresponding regions 54, such as those enclosed by dotted line 56 in FIG. 4. The light emitted by regions 64 produces the display's image on the exterior faceplate surface.

As indicated in FIG. 3, light-emissive regions 64 are spaced largely uniformly apart from one another in the column direction. Each pair of consecutive regions 64 in a column is thus at approximately the same center-to-center spacing as each other pair of consecutive regions 64 in that column. In other words, the center-to-center spacings between pairs of consecutive rows of regions 64 are largely the same in the display of FIGS. 3 and 4.

With the center-to-center spacing between pairs of consecutive rows of electron-emissive regions 54 alternating between spacing $S_{EC1}$ and spacing $S_{EC2}$ in the display of FIGS. 3 and 4, each light-emissive region 64 is slightly laterally offset from corresponding electron-emissive region 54 in the column direction. For example, the first light-emissive region 64 starting from the left-hand side of FIG. 3 is slightly laterally to the left of the corresponding first electron-emissive region 54 starting from the left-hand side of FIG. 3. The second light-emissive region 64 starting from the left-hand side of FIG. 3 is, in a complementary manner, slightly laterally to the right of the corresponding second electron-emissive region 54 starting from the left-hand side of FIG. 3.

Light-emissive regions 64 are also spaced largely uniformly apart from one another in the row direction in the display of FIGS. 3 and 4. Hence, each pair of consecutive regions 64 in a row is at approximately the same center-to-center spacing as each other pair of consecutive regions 64 in that row. Alternatively stated, the center-to-center spacings between pairs of consecutive columns of regions 64 are largely the same. Also, the columns of regions 64 are not (significantly) laterally offset in the row direction relative to the columns of electron-emissive regions 54. In other words, each column of light-emissive regions 64 is substantially directly opposite the corresponding column of electron-emissive regions 54.

Figure 2:
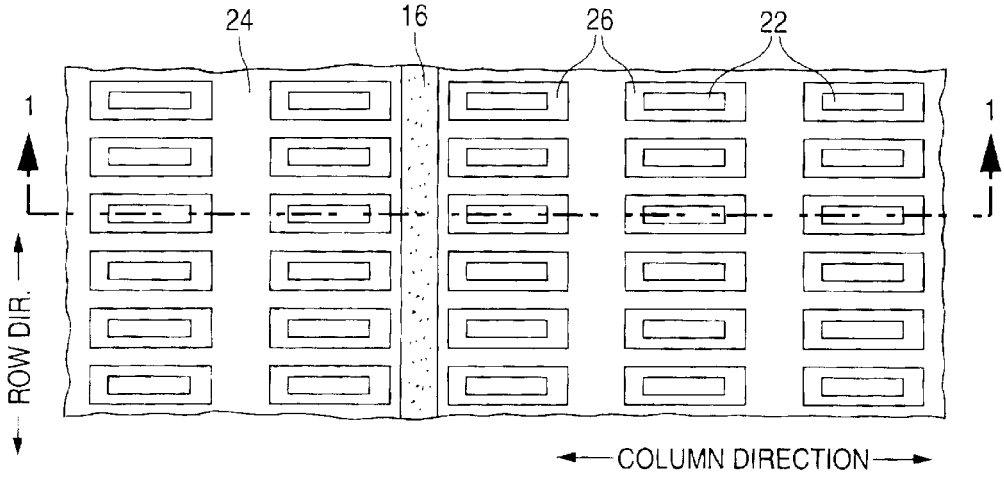
Fig. 2 PRIOR ART
FIG. 2 is a cross-sectional plan view of part of the active region of the conventional flat-panel display, specifically the electron-emitting device, of FIG. 1. The cross section of FIG. 1 is taken through plane 1—1 in FIG. 2. The cross-section of FIG. 2 is taken through plane 2—2 in FIG. 1.

Black matrix 66 laterally surrounds each light-emissive region 64 and appears dark, largely black, as viewed from the front of the display. Matrix 66 enhances the contrast of the display's image. In the example of FIG. 1, matrix 66 extends vertically beyond light-emissive regions 64. Alternatively, regions 64 may extend vertically beyond matrix 66.

The anode (again not shown) in the display of FIGS. 3 and 4 may be situated above or below light-emissive regions 64 and black matrix 66. When situated above (below in the orientation of FIG. 3) components 64 and 66, the anode is normally light reflective. This enables the anode to reflect forward some of the initially rear-directed light emitted by regions 64 so as to enhance the image intensity. When the anode is situated between faceplate 60, on one hand, and components 64 and 66, on the other hand, the anode is normally largely transparent. In either case, a high anode electrical potential, typically in the vicinity of 500–10,000 volts compared to the average of the various voltages provided to electron-emitting device 40, is furnished to the anode during display operation.

The display of FIGS. 3 and 4 operates in the following manner. Appropriate voltages are supplied to layers/regions 52 to cause electrons emitted from selected ones of regions 54 to escape electron-emitting device 40 and be attracted to light-emitting device 42 by the high anode potential. This may involve extracting electrons from selected ones of regions 54 by field emission. Alternatively, regions 54 may continuously emit electrons according to a phenomenon such as thermal emission. Regions 54 then include componentry for collecting electrons emitted by non-selected ones of regions 54 so that electrons emitted by the remaining, selected, ones of regions 54 travel toward light-emitting device 42. Item 68 in FIG. 3 represents a trajectory of an electron emitted by one of regions 54 and traveling toward device 42.

The display in FIGS. 3 and 4 includes a control capability, examples of which are described below, for focusing electrons emitted by each region 54 on the corresponding oppositely situated light-emissive region 64. The control capability appropriately compensates for the lateral offsets of light-emissive regions 64 relative to electron-emissive regions 54 in the column direction. Upon being struck by electrons of suitably high energy, regions 64 emit light to produce the display's image on the front of the display. With each color pixel providing a dot of the display's image, each sub-pixel formed with an electron-emissive region 54 and the oppositely situated light-emissive region 64 provides part of the dot of the image.

Figure 5:
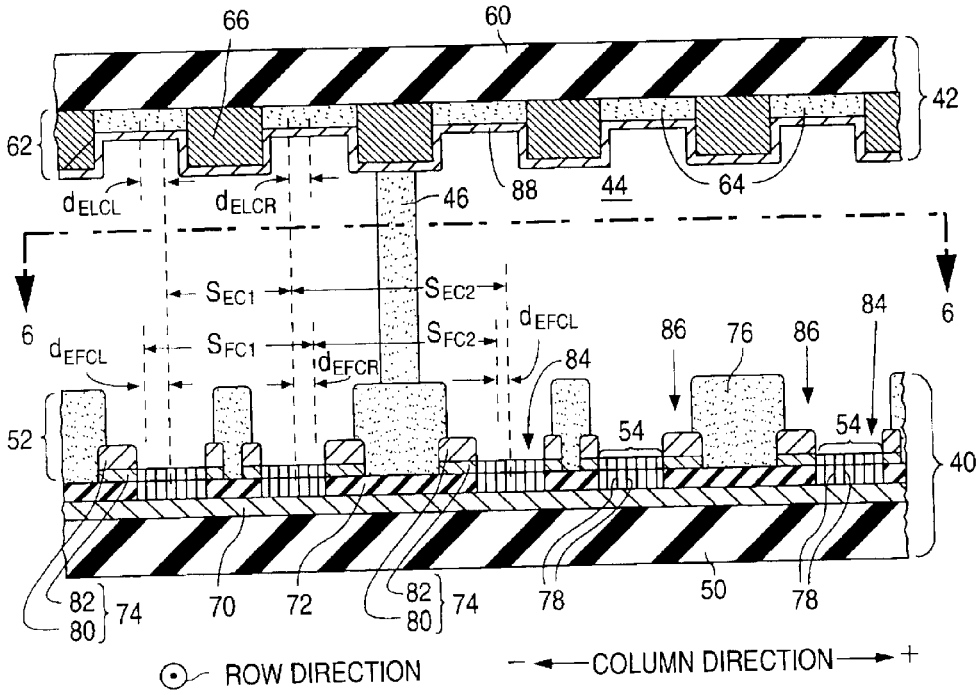
FIG. 5 is a cross-sectional side view of part of the active region of a field-emission implementation of the inventive flat-panel display of FIG. 3.
Figure 6:
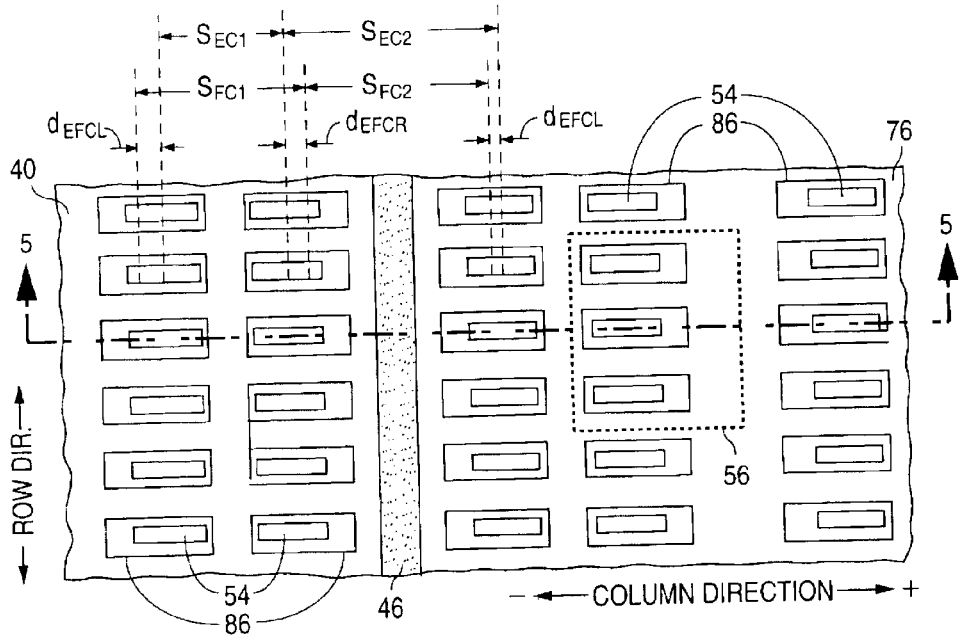
FIG. 6 is a cross-sectional plan view of part of the active region of the field-emission implementation of FIG. 5. The cross section of FIG. 5 is taken through plane 5—5 in FIG. 6. The cross section of FIG. 6 is taken through plane 6—6 in FIG. 5.

FIGS. 5 and 6 respectively illustrate side and plan-view cross sections of part of the active region of a field-emission implementation of the general flat-panel CRT display of FIGS. 3 and 4 in accordance with the invention. Analogous to FIG. 4, the cross section of FIG. 6 is taken in the direction of electron-emitting device 40 along a plane extending laterally through enclosure 44. FIG. 6 thus largely presents a plan view of part of the active portion of device 40.

Electron-emitting device 40 in the field-emission flat-panel CRT display ("field-emission display") of FIGS. 5 and 6 is formed with backplate 50 and layer/regions 52 as described above for the general display of FIGS. 3 and 4. In addition to electron-emissive regions 54, layer/regions 52 in the field-emission display ("FED") of FIGS. 5 and 6 consist of a lower electrically non-insulating region 70, a dielectric layer 72, a group of laterally separated generally parallel control electrodes 74, and an electron-focusing system 76.

Lower non-insulating region 70 contains a group of laterally separated generally parallel emitter electrodes (not separately shown) situated on backplate 50. The emitter electrodes extend longitudinally in the column direction. Non-insulating region 70 also normally includes an electrically resistive layer (likewise not separately shown) which overlies the emitter electrodes and, dependent on its lateral shape, may extend down to backplate 50 in the spaces between the emitter electrodes. At a minimum, the resistive layer underlies electron-emissive regions 54.

Dielectric layer 72 lies on lower non-insulating region 50 and, dependent on the shape of the resistive layer, may extend down to backplate 70 in the spaces between the emitter electrodes. Each electron-emissive region 54 consists of multiple electron-emissive elements 78 situated largely in openings (not explicitly shown) extending through dielectric layer 72. Electron-emissive elements 78 of each region 54 are situated on a portion of the resistive layer above one of the emitter electrodes. Each element 78 typically consists of a cone or filament formed with metal such as molybdenum.

Control electrodes 74 lie on dielectric layer 72 and extend longitudinally generally parallel to one another in the row direction. Each control electrode consists of a main control portion 80 and an adjoining gate portion 82 situated above or below main control portion 80. FIG. 5 illustrates an example in which gate portion 82 extends below adjoining main control portion 80. A main group of control openings 84 extend through main control portions 80 respectively above electron-emissive regions 54. Electron-emissive elements 78 of each region 54 are exposed through openings (not explicitly shown) in associated gate portion 82 at the bottom of corresponding main control opening 84. The size, orientation, and lateral shape of each region 54 is defined by overlying control opening 84.

Gate portion 82 of each control electrode 74 may extend continuously across the active portion of electron-emitting device 40 or may be divided into laterally separated segments, typically one for each electron-emissive region 54 controlled by that electrode 74. In addition to the associated electron-emissive elements 78, each region 54 may be deemed to include the underlying part of the associated emitter electrode and the overlying part of associated gate portion 82.

Electron-focusing system 76 is situated on dielectric layer 72 and extends over control electrodes 74. A group of focus openings 86 arranged in rows and columns respectively corresponding to the rows and columns of electron-emissive regions 54 extend through system 76 down to electrodes 74. Accordingly, there at least three, and normally considerable more than three, focus openings 86 in each row of openings 86. The same applies to the columns of openings 86.

A suitable focus potential is applied to electron-focusing system 76 from an appropriate voltage source (not shown). An example of the internal configuration of system 76 is presented later in FIG. 21. In any event, system 76 is normally configured so that material carrying the focus potential extends from the tops of focus openings 86 at least partway down into each of them. Material carrying the focus potential also typically extends along the top of system 76.

Each focus opening 86 is located above a corresponding different one of electron-emissive regions 54 so as to fully expose that region 54 to enclosure 44. As viewed perpendicular to backplate 50, the lateral boundary of each region 54 is preferably fully situated within the lateral boundary of corresponding opening 86. Electrons emitted by each region 54 pass through overlying opening 86 on their way to light-emitting device 42.

Analogous to electron-emissive regions 54, focus openings 86 can be configured laterally in various ways. Openings 86 are typically of largely the same size, of largely the same lateral orientation, and are largely laterally symmetrical about their centerlines (not shown) in the row direction. FIG. 6 depicts an example in which openings 86 are shaped laterally generally as rectangles of considerably greater dimension in the column direction than in the row direction. When openings 86 are so shaped, electron-focusing system 76 is configured laterally like a waffle.

In general, focus openings 86 are configured so that (as viewed perpendicular to backplate 50) openings 86 in each row are largely mirror images, relative to the row direction, of openings 86 in each directly adjacent row. Hence, openings 86 in alternating rows are largely mirror images, relative to the row direction, of openings 86 in the remaining alternating rows. Openings 86 are typically configured in this alternating mirror-image arrangement when electron-emissive regions 54 are configured, as described above, in a corresponding alternating mirror-image arrangement relative to the row direction. The layout of FIG. 6 is the limiting case of the two alternating mirror-image arrangements in which regions 54 and openings 86 are laterally symmetrical about their centerlines in the row direction.

Focus openings 86 are positioned above electron-emissive regions 54 so as to enable electron-focusing system 76 to compensate for the lateral offsets of light-emissive regions 64 to corresponding electron-emissive regions 54 in the column direction. The compensation is achieved by appropriately offsetting the positions of openings 86 in the column direction relative to the positions of electron-emissive regions 54 in the column direction. That is, each region 54 and corresponding opening 86 are at a suitable non-zero center-to-center spacing in the column direction. The offset of each opening 86 to underlying region 54 is normally in the same absolute direction, but at a lesser magnitude, than the offset of corresponding light-emissive region 64 to that electron-emissive region 54.

More particularly, let the column direction to the right in FIGS. 5 and 6 be referred to as the positive column direction while the column direction to the left in FIGS. 5 and 6 is referred to as the negative column direction. Consider a light-emissive region 64, such as the first one starting from the left-hand side of FIG. 5, offset in the negative column direction relative to corresponding electron-emissive region 54. The center-to-center spacing from that region 54 to corresponding light-emissive region 64 is at a non-zero offset value $d_{ELCL}$ in the negative column direction. Focus opening 86 overlying that region 54 is likewise offset in the negative column direction relative to that region 54. The center-to-center spacing from that region 54 to overlying opening 86 is at a suitable non-zero offset value $d_{EFCL}$ in the negative column direction.

As FIGS. 5 and 6 show, offset spacing $d_{EFCL}$ from the afore-mentioned electron-emissive region 54 to overlying focus opening 86 is less than offset spacing $d_{ELCL}$ from that region 54 to corresponding light-emissive region 64. That electron-emissive region 54 is therefore closer to the right-hand side of overlying focus opening 86 than to its left-hand side. Due to the focus potential applied to electron-focusing system 76, electrons emitted by that region 54 are diverted slightly in the negative column direction so as to compensate for the lateral offset of corresponding light-emissive region 64 to that electron-emissive region 54 in the negative column direction.

The opposite arises with a light-emissive region 64, such as the second one starting from the left-hand side of FIG. 5, offset in the positive column direction relative to corresponding electron-emissive region 54. The center-to-center spacing from that region 54 to corresponding light-emissive region 64 is at a non-zero offset value $d_{ELCR}$ in the positive column direction. Focus opening 86 overlying that electron-emissive region 54 is also offset in the positive column direction relative to that region 54. The center-to-center spacing from that region 54 to overlying opening 86 is at a suitable non-zero offset value $d_{EFCR}$ in the positive column direction.

Offset spacing $d_{EFCR}$ is less than spacing offset spacing $d_{ELCR}$ as indicated in FIGS. 5 and 6. Hence, the just-mentioned electron-emissive region 54 is closer to the left-hand side of overlying focus opening 86 than to its right-hand side. Consequently, electrons emitting by that region 54 are diverted slightly in the positive column direction to compensate for the lateral offset of corresponding light-emissive region 64 to that electron-emissive region 54 in the positive column direction. Overall, offset spacing $d_{EFCL}$ or $d_{EFCR}$ of each focus opening 86 to underlying electron-emissive region 54 is thus in the same negative or positive (column) direction as, but at a lesser magnitude than, offset spacing $d_{ELCL}$ or $d_{ELCR}$ of corresponding light-emissive region 64 to that electron-emissive region 54.

The pair of focus openings 86 overlying each first, more narrowly separated, pair of electron-emissive regions 54 are at a center-to-center spacing $S_{FC1}$ in the column direction. In light of the foregoing offset of openings 86 to underlying regions 54, center-to-center focus spacing $S_{FC1}$ is the sum of center-to-center electron-emission spacing $S_{EC1}$ and offset spacings $d_{EFCL}$ and $d_{EFCR}$. Center-to-center electron-emission spacing $S_{EC1}$ is thus less than center-to-center focus spacing $S_{FC1}$. In other words, each first pair of regions 54 is at a lesser center-to-center spacing in the column direction than the pair of respectively overlying openings 86.

The opposite arises with each second, more widely separated, pair of electron-emissive regions 54 and the respectively overlying pair of focus openings 86. This pair of openings 86 is at a center-to-center spacing $S_{FC2}$ in the column direction. Center-to-center electron-emission spacing $S_{EC2}$ is the sum of center-to-center focus spacing $S_{FC2}$ and offset spacings $d_{EFCR}$ and $d_{EFCL}$. As a result, center-to-center electron-emission spacing $S_{EC2}$ is greater than center-to-center focus spacing $S_{FC2}$. Each second pair of regions 54 is thus at a greater center-to-center spacing in the column direction than the pair of respectively overlying openings 86.

As mentioned above in connection with the display of FIGS. 3 and 4, each column of light-emissive regions 64 is situated substantially opposite the corresponding column of electron-emissive regions 54. Hence, each light-emissive region 64 is not significantly offset in the row direction from corresponding electron-emissive region 54. Accordingly, each focus opening 86 is not significantly offset in the row direction from underlying electron-emissive region 54.

Layers/regions 62 in light-emitting device 42 include a thin light-reflective anode layer 88 situated over light-emissive regions 64 and black matrix 66. The display's anode potential is furnished to light-reflective anode layer 88 from a suitable voltage source (not shown). When electrons emitted by regions 54 impinge on device 42, the electrons pass through light-reflective layer 88 before striking light-emissive regions 64 and causing light emission.

As indicated in FIG. 5, spacer walls 46 extend from electron-focusing system 76 to light-reflective layer 88. Each wall 46 contacts system 76 above the space between one of the second, more widely separated, pairs of consecutive rows of electron-emissive regions 54. In particular, each wall 46 contact system 76 above the space between two consecutive rows of focus opening 86 respectively overlying electron-emissive regions 54 of one of the second pairs of consecutive rows of regions 54. Each wall 46 also contacts light-reflective layer 88 above black matrix 66.

Figure 7:
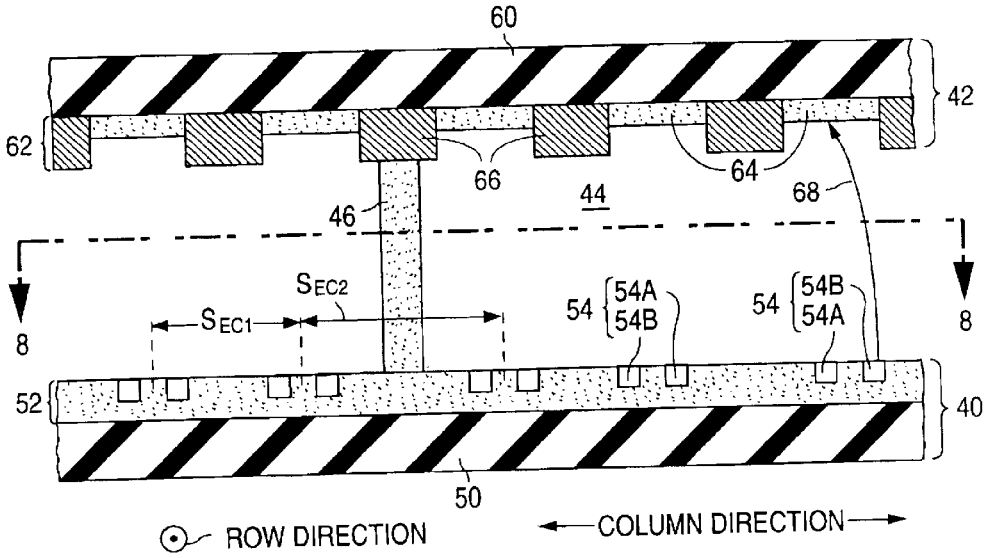
FIG. 7 is a cross-sectional side view of part of the active region of another flat-panel CRT display having rows of electron-emissive regions spaced non-uniformly apart from one another according to the invention.
Figure 8:
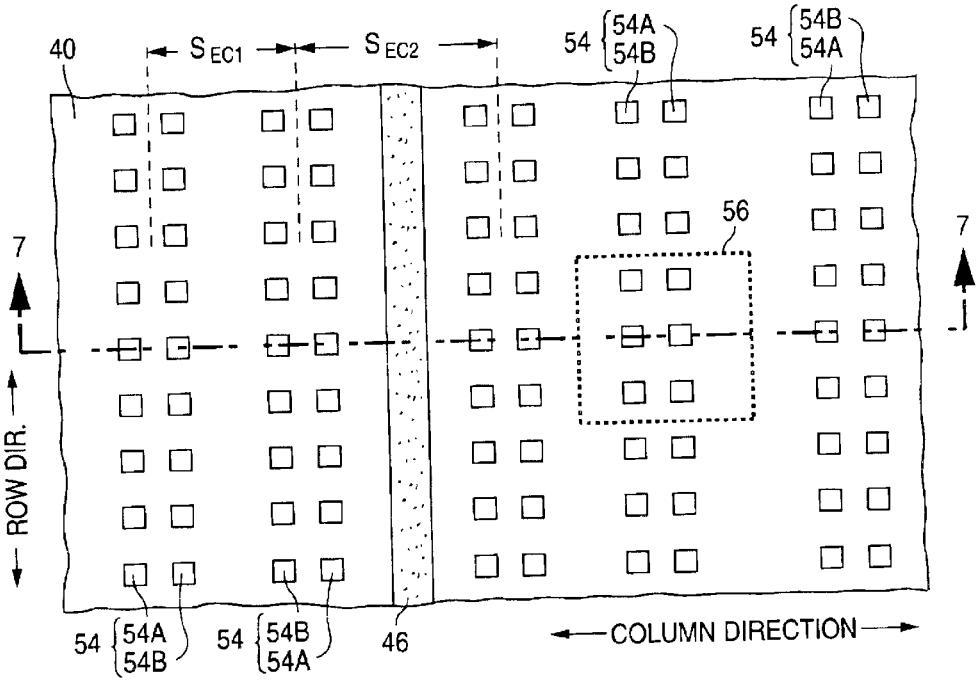
FIG. 8 is a cross-sectional plan view of part of the active region of the flat-panel display, specifically the electron-emitting device, of FIG. 7. The cross section of FIG. 7 is taken through plane 7—7 in FIG. 8. The cross section of FIG. 8 is taken through plane 8—8 in FIG. 7.

FIGS. 7 and 8 respectively depict side and plan-view cross sections of part of the active region of another general flat-panel CRT display in which electron-emissive regions situated in a line, once again a column, extending in a main direction, again the column direction, are spaced non-uniformly apart from one another in accordance with the invention for improving space utilization. The display of FIGS. 7 and 8 contains electron-emitting device 40, light-emitting device 42, and spacer walls 46 arranged and operable the same as described above in connection with the display of FIGS. 3 and 4 except that electron-emissive regions 54 are configured differently in the display of FIGS. 7 and 8 than in the display of FIGS. 3 and 4. Analogous to the display of FIGS. 3 and 4, the plan-view cross section of FIG. 8 is taken in the direction of electron-emitting device 40 along a plane extending through enclosure 44. FIG. 8 thereby largely presents a plan view of part of the active portion of device 40.

Each electron-emissive region 54 in the display of FIGS. 7 and 8 consists of two electron-emissive portions 54A and 54B spaced laterally apart from each other in the column direction. Provided that portions 54A and 54B of each region 54 are both operative, both of portions 54A and 54B in that region 54 normally emit electrons substantially simultaneously whenever that region 54 emits electrons. Accordingly, portions 54A and 54B of each region 54 are controlled together.

The spacings between consecutive rows of electron-emissive regions 54 in the display of FIGS. 7 and 8 are arranged in a non-uniform manner in basically the same way as in the display of FIGS. 3 and 4. Hence, the rows of regions 54 are allocated into alternating first and second pairs of consecutive rows of regions 54 for which the distance between each second pair of consecutive rows of regions 54 is, in accordance with the invention, significantly greater than the distance between each first pair of consecutive rows of regions 54.

As indicated in FIGS. 7 and 8, electron-emissive portions 54A respectively form the left-hand parts of electron-emissive regions 54 in the left-hand row of regions 54 in each first, or more narrowly separated, pair of consecutive rows of regions 54 whereas portions 54A respectively form the right-hand parts of regions 54 in the right-hand row of regions 54 in that first pair of consecutive rows of regions 54. The opposite applies to electron-emissive portion 54A and 54B in each second, or more widely separated, pair of consecutive rows of regions 54. Accordingly, the distance between the two rows in each second pair of consecutive rows of regions 54 is the distance from portions 54A in one of the rows to portions 54A in the other row. The distance between the two rows in each first pair of consecutive rows of regions 54 is the distance from electron-emissive portions 54B in one of the rows to portions 54B in the other row.

Portions 54A and 54B of electron-emissive regions 54 can be configured laterally in various ways. Portions 54A are typically of largely the same size and of largely the same orientation and lateral shape. Portions 54B are likewise typically of largely the same size and of largely the same orientation and lateral shape. More particularly, portions 54A and 54B are typically largely symmetrical about their centerlines (not shown) in the row direction. Portions 54A and 54B are typically shaped laterally generally as rectangles. Each rectangle is usually of greater dimension in the column direction than in the row direction.

In any event, the lateral separation between portions 54A and 54B of each electron-emissive region 54 is largely the same in the column direction for all regions 54. Also, any center-to-center offset between portion 54A and 54B of each region 54 in the row direction is largely the same for all regions 54.

Electron-emissive portions 54B may be largely identical to, and oriented largely the same as, electron-emissive regions 54A. Portions 54B are then of largely the same size and lateral shape as portions 54A. In that case, electron-emissive regions 54 are largely identical since the lateral column-direction spacing between, and any center-to-center row direction offset between, portions 54A and 54B of each region 54 is largely the same for all regions 54. This example is depicted in FIG. 8 where portions 54A and 54B are shaped laterally as largely identical rectangles of greater dimension in the column direction than in the row direction.

More generally, electron-emissive portions 54A and 54B are configured so that (as viewed perpendicular to backplate 50) electron-emissive regions 54 in each row are largely mirror images, relative to the row direction, of regions 54 in each directly adjacent row. Regions 54 in alternating rows are thus largely mirror images, relative to the row direction, of regions 54 in the remaining alternating rows. The layout of FIG. 8 is an example of the limiting case of this alternating mirror-image arrangement in which portions 54A and 54B are largely laterally symmetrical about their centerlines in the row direction.

In order to achieve the alternating mirror-image layout of electron-emissive regions 54 in the FED of FIGS. 7 and 8, electron-emissive portions 54A in each row of regions 54 need to be of largely the same size and have largely the same orientation and lateral shape. Electron-emissive portions 54B in each row of regions 54 likewise need to be of largely the same size and have largely the same orientation and lateral shape.

Subject to the lateral column-direction spacing between, and any center-to-center row-direction offset between, portions 54A and 54B of each electron-emissive region 54 being the same for all regions 54, the alternating mirror-image arrangement of regions 54 can be achieved by configuring portions 54A or 54B in each row of regions 54 to be largely mirror images, relative to the row direction, of portions 54A or 54B in each directly adjacent row of regions 54, where the row-direction mirror-images are laterally asymmetrical about their centerlines in the row directions. The alternating mirror-image arrangement can also be achieved by configuring portions 54B to be of significantly different lateral shape than portions 54A without requiring that portions 54A or 54B be laterally asymmetrical about their centerlines in the row direction. For instance, portions 54B can simply be longer or shorter than portions 54A in the column direction.

Portions 54A and 54B of each electron-emissive region 54 have a composite center which, due to the spacing between portions 54A and 54B of that region 54, often lies between portions 54A and 54B of that region 54. The composite center of portions 54A and 54B of each region 54 is the center of that region 54. With this in mind, consecutive rows of regions 54 in the display of FIGS. 7 and 8 satisfy the same center-to-center spacing criteria as in the display of FIGS. 3 and 4. All of the first pairs of consecutive rows of regions 54 in the display of FIGS. 7 and 8 are thus at approximately the same center-to-center spacing $S_{EC1}$. All of the second pairs of consecutive rows of regions 54 in the display of FIGS. 7 and 8 are at approximately the same center-to-center spacing $S_{EC2}$ which is normally at least 3% greater than, preferably at least 5% greater than, more preferably at least 10% greater than, and even more preferably at least 20% greater than, center-to-center spacing $S_{EC1}$.

Rather than being divided into two portions 54A and 54B laterally separated in the column direction, each electron-emissive region 54 can be divided into more than two electron-emissive portions laterally separated in the column direction. There are various reasons for implementing each region 54 as two or more portions laterally separated in the column direction. Since spacer walls 46 extend in the row direction, the presence of walls 46 can cause electrons emitted by regions 54, especially those regions 54 closest to walls 46, to be deflected in the column direction. When each region 54 is implemented as a unitary (continuous) region, electrons traveling from that region 54 to oppositely situated light-emissive region 64 concentrate at a location, preferably the center, of that region 64. The presence of walls 46 can degrade the image by causing electrons emitted by certain of regions 54, especially those regions 54 closest to walls 46, to concentrate at locations significantly displaced in the column direction from the centers of oppositely situated light-emissive regions 64.

The foregoing problem can be alleviated by dividing each electron-emissive region 54 into two or more electron-emissive portions laterally separated in the column direction and appropriately controlling the focusing of electrons emitted by the two or more portions of that region 54. This electron-focusing technique is further described in International Patent Publication WO 00/02081, the contents of which are incorporated by reference herein. In brief, appropriately implementing each region 54 as two or more portions, such as electron-emissive portions 54A and 54B, enables the profile of the intensity at which electrons emitted by those two or more portions strike the oppositely situated light-emissive region 64 to be flatter in the column direction. As a result, column-direction electron deflection caused, for example, by the presence of spacer walls 46 has less effect on the light provided by regions 64 and thus less damaging effect on the display's image.

Aside from configuring each of electron-emissive regions 54 as electrons-emissive portions 54A and 54B and the consequent effect of configuring regions 54 in that manner, the display of FIGS. 7 and 8 operates substantially the same as the display of FIGS. 3 and 4. Hence, the display of FIGS. 7 and 8 includes a control capability for focusing electrons emitted by portions 54A and 54B of each region 54 on oppositely situated light-emissive region 64. The control capability appropriately compensates for the lateral offsets of light-emissive regions 64 relative to electron-emissive regions 54 in the column direction.

Figure 9:
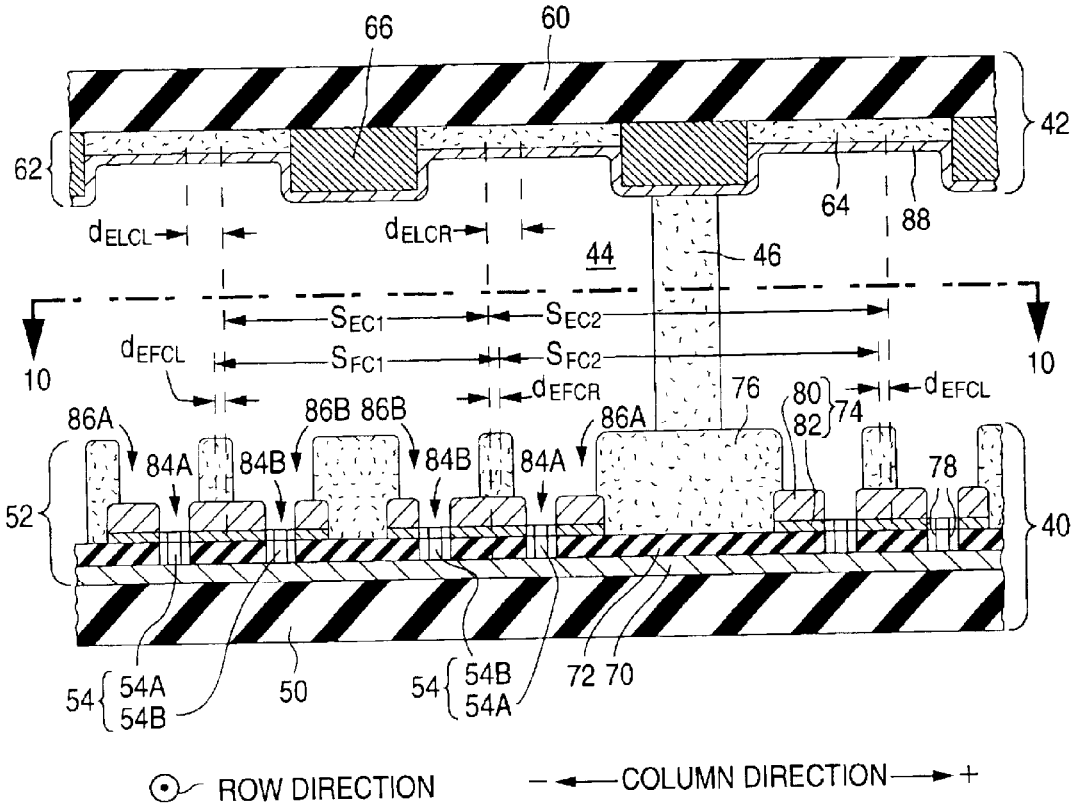
FIG. 9 is a cross-sectional side view of part of the active region of one field-emission implementation of the inventive flat-panel display of FIG. 7.
Figure 10:
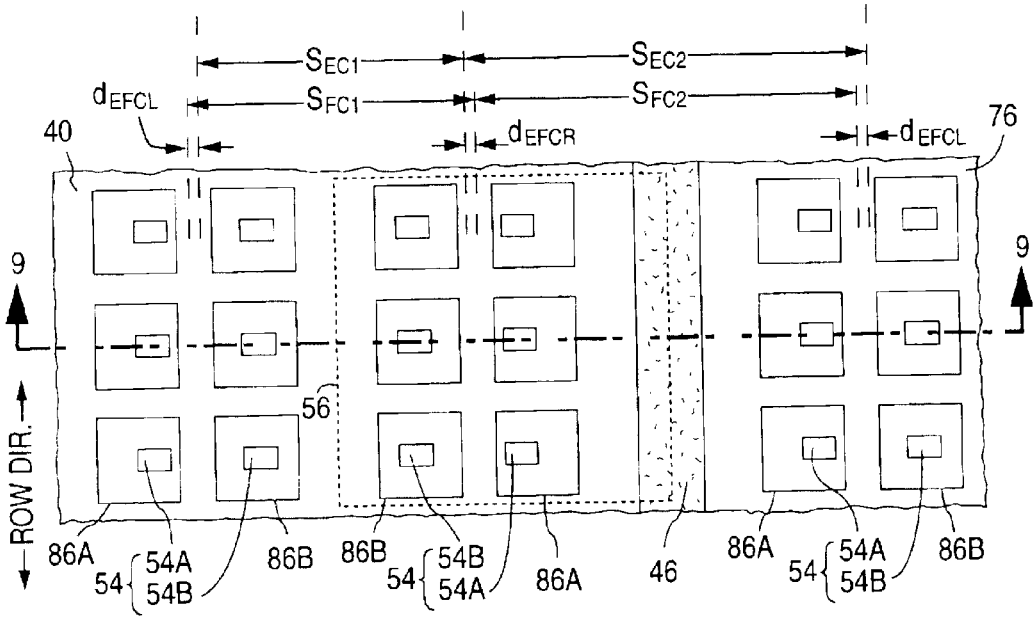
FIG. 10 is a cross-sectional plan view of part of the active region of the field-emission implementation of FIG. 9. The cross section of FIG. 9 is taken through plane 9—9 in FIG. 10. The cross section of FIG. 10 is taken through plane 10—10 in FIG. 9.

FIGS. 9 and 10 respectively illustrate side and plan-view cross sections of part of the active region of a field-emission implementation of the flat-panel CRT display of FIGS. 7 and 8 in accordance with the invention. As with FIG. 8, the cross section of FIG. 10 is taken in the direction of electron-emitting device 40 along a plane extending laterally through enclosure 44. Accordingly, FIG. 10 largely presents a plan view of part of the active portion of device 40.

The FED of FIGS. 9 and 10 implements the general flat-panel display of FIGS. 7 and 8 in the same way that the FED of FIGS. 5 and 6 implements the general flat-panel display of FIGS. 3 and 4. In addition to backplate 50, electron-emitting device 40 in the FED of FIGS. 9 and 10 contains electron-emissive regions 54, lower non-insulating region 70, dielectric layer 72, control electrodes 74, and electron-focusing system 76 arranged and operating the same as in the FED of FIGS. 5 and 6 except for differences that arise from implementing each region 54 as a pair of electron-emissive regions 54A and 54B laterally separated in the column direction. Each portion 54A or 54B of each region 54 consists of multiple electron-emissive elements 78, again typically cones or filaments.

A group of main control openings 84A and 84B extend through main control portions 80 of control electrodes 74 respectively above electron-emissive regions 54A and 54B. The pair of main control openings 84A and 84B situated respectively above portions 54A and 54B of each electron-emissive region 54 are laterally separated in the column direction. In effect, each main control opening 84 in the FED of FIGS. 5 and 6 is replaced with a pair of openings 84A and 84B in the FED of FIGS. 9 and 10. Electron-emissive elements 78 of each portion 54A or 54B are exposed through openings in gate portion 82 of associated control electrode 74 at the bottoms of corresponding opening 84A or 84B. The size, orientation, and lateral shape of each portion 54A or 54B is defined by overlying opening 84A or 84B.

A group of focus openings 86A and 86B extend through electron-focusing system 76 down to control electrodes 74. Each focus opening 86A and 86B is located above a corresponding different one of electron-emissive portions 54A or 54B so as to fully expose that portion 54A or 54B. As viewed perpendicular to backplate 50, the lateral boundary of each portion 54A or 54B is preferably situated fully within the lateral boundary of corresponding opening 86A or 86B. Electrons emitted by each portion 54A or 54B pass through overlying opening 86A or 86B on their way to light-emitting device 42. As with focus openings 86 in the FED of FIGS. 5 and 6, electron-focusing system 76 in the FED of FIGS. 9 and 10 is normally configured so that the material carrying the focus potential extends from the tops of openings 86A and 86B at least partway down into each of them.

The pair of focus openings 86A and 86B which respectively expose portions 54A and 54B of each electron-emissive region 54 are laterally separated in the column direction. Openings 86A and 86B thereby form an array of rows and columns in which each row (extending in the row direction) consists solely of openings 86A or solely of openings 86B. Each column (extending in the column direction) consists of an opening 86A followed by a pair of openings 86B, a pair of openings 86A, a pair of openings 86B, and so on in an alternating pair arrangement. Each focus opening 86 in the FED of FIGS. 5 and 6 is effectively replaced with a pair of openings 86A and 86B in the FED of FIGS. 9 and 10. Hence, there are at least six, and normally considerably more than six, openings 86A and 86B in each column of openings 86A and 86B.

Analogous to both focus openings 86 in the FED of FIGS. 5 and 6 and to electron-emissive portions 54A and 54B in the display of FIGS. 7 and 8, focus openings 86A and 86B in the FED of FIGS. 9 and 10 can be configured laterally in various ways. Openings 86A are typically of largely the same size and of largely the same orientation and lateral shape. Openings 86B are likewise typically of largely the same size and of largely the same orientation and lateral shape. More particularly, openings 86A and 86B are typically largely symmetrical about their centerlines (not shown) in the row direction. Openings 86A and 86B are typically shaped laterally generally as rectangles. Although not indicated in FIG. 10, each rectangle is usually of greater dimension in the column direction than in the row direction.

Let a "pair" of focus openings 86A and 86B here mean two directly adjacent openings 86A and 86B that respectively expose portions 54A and 54B of an electron-emissive region 54. The lateral spacing between each pair of openings 86A and 86B is largely the same in the column direction for all such focus-opening pairs. In addition, any center-to-center offset between each pair of openings 86A and 86B in the row direction is largely the same for all the focus-opening pairs.

Focus openings 86B may be largely identical to, and of largely the same orientation as, focus openings 86A. Openings 86B are then of largely the same size and lateral shape as openings 86A. In that case, all the pairs of openings 86A and 86B are largely identical since the lateral column-direction spacing between, and any center-to-center row-direction offset between, each pair of openings 86A and 86B is largely the same for all the pairs of openings of 86A and 86B. This example is shown in FIGS. 10 where openings 86A and 86B are shaped laterally as largely identical rectangles.

Let a "pair" of rows of focus openings 86A and 86B here mean two directly adjacent rows of openings 86A and 86B that respectively expose electron-emissive portions 54A and 54B of a row of electron-emissive regions 54. With that in mind, openings 86A and 86B are normally configured so that (as viewed perpendicular to backplate 50) openings 86A and 86B in each pair of rows of openings 86A and 86B are respectively largely mirror images, relative to the row direction, of openings 86A and 86B in each directly adjacent pair of rows of openings 86A and 86B. Openings 86A and 86B in alternating pairs of rows of openings 86A and 86B are thus respectively largely mirror images relative to the row direction, of openings 86A and 86B in the remaining alternating pairs of rows of openings 86A and 86B. Opening 86A and 86B are typically configured in this alternating pair mirror-image arrangement when portions 54A and 54B of a row of electron-emissive regions 54 are configured, as described above, in a corresponding alternating pair mirror-image arrangement relative to the row direction. The layout of FIG. 10 is an example of the limiting case of this alternating pair mirror-image arrangement in which openings 86A and 86B are largely laterally symmetrical about their centerlines in the row direction. In order to achieve the alternating focus-opening pair mirror-image arrangement openings, openings 86A in each row of openings 86A need to be of largely the same size and have largely the same orientation and lateral shape. Openings 86B in each row of openings 86B likewise need to be of largely the same size and have largely the same orientation and lateral shape.

Subject to the lateral column-direction spacing between, and any center-to-center row-direction offset between, each pair of focus openings 86A and 86B being largely the same for all the pairs of openings 86A and 86B, the alternating pair mirror-image arrangement of openings 86A and 86B can be achieved by configuring openings 86A or 86B in each pair of rows of openings 86A and 86B to respectively be largely mirror images, relative to the row direction, of openings 86A or 86B in each directly adjacent pair of rows of openings 86A and 86B, where the row-direction mirror images are largely laterally asymmetrical about their centerlines in the row direction. The alternating pair mirror-image arrangement of openings 86A and 86B can also be achieved by configuring openings 86B to be of significantly different lateral shape than openings 86A without requiring the openings 86A and 86B be laterally symmetrical about their centerlines in the row direction. For instance, openings 86B can simply be longer or shorter than openings 86A in the column direction.

Focus openings 86A and 86B are positioned respectively above portions 54A and 54B of electron-emissive regions 54 for enabling electron-focusing system 76 to compensate for the lateral offsets of light-emissive regions 64 to corresponding electron-emissive regions 54 in the column direction. The compensation is achieved by appropriately offsetting the positions of openings 86A and/or 86B in the column direction relative to the positions of portions 54A and/or 54B in the column direction. That is, each portion 54A and overlying opening 86A are at a suitable non-zero center-to-center offset spacing in the column direction and/or each portion 54B and overlying opening 86B are at a suitable non-zero center-to-center offset spacing in the column direction. The compensation can sometimes be attained by offsetting the positions of openings 86A in the column direction relative to the positions of portions 54A in the column direction without significantly offsetting the positions of portions 86B in the column direction relative to positions of portions 54B in the column direction, and vice versa.

In utilizing focus openings 86A and 86B to compensate for the lateral offsets of light-emissive regions 64 to corresponding electron-emissive regions 54 in the column direction, each pair of openings 86A and 86B is treated as a group. More particularly, each pair of openings 86A and 86B has a composite center which, due to the separation between openings 86A and 86B of that pair, often lies between that pair of openings 86A and 86B. Subject to each electron-emissive region 54 being implemented as portions 54A and 54B laterally separated in the column direction and subject to each focus opening 86 of the FED of FIGS. 5 and 6 being effectively replaced with a pair of openings 86A and 86B in the FED of FIGS. 9 and 10, the compensation for the lateral offsets of light-emissive regions 64 to corresponding electron-emissive regions 54 in the FED of FIGS. 9 and 10 is achieved in largely the same way as in the FED of FIGS. 5 and 6.

Consider a light-emissive region 64, such as the first one starting from the left-hand side of FIG. 9, offset in the negative column direction relative to corresponding electron-emissive region 54. The spacing from the composite center of portions 54A and 54B of that region 54 to the center of corresponding light-emissive regions 64 is at non-zero offset value $d_{ELCL}$ in the negative column direction. The pair of focus openings 86A and 86B overlying portions 54A and 54B of that electron-emissive regions 54 are, as a group, likewise offset in the negative column direction relative to that region 54. The spacing from the composite center of portions 54A and 54B of that region 54 to the composite center of the overlying pair of openings 86A and 86B is at non-zero offset value $d_{EFCL}$ in the negative column direction.

As FIGS. 9 and 10 show, offset spacing $d_{EFCL}$ from the composite center of portions 54A and 54B of the aforementioned light-emissive region 54 to the composite center of the overlying pair of focus openings 86A and 86B is less than offset spacing $d_{ELCL}$ from the composite center of portions 54A and 54B of that region 54 to the center of corresponding light-emissive region 64. That electron-emissive region 54 is thus closer to the right-hand side of the overlying pair of openings 86A and 86B than to their left-hand side. Due to the focus potential applied to electron-focusing system 76, the electrons emitted by portions 54A and 54B of that region 54 are, on the average, diverted slightly in the negative column direction so as to compensate for the lateral offset of corresponding light-emissive region 54 to that electron-emissive region 54 in the negative column direction.

The opposite occurs with a light-emissive region 64, such as the second one starting from the left-hand side of FIG. 9, offset in the positive column direction relative to corresponding electron-emissive region 54. The spacing from the composite center of portions 54A and 54B of that region 54 to the center of corresponding light-emissive region 64 is at non-zero offset value $d_{ELCR}$ in the positive column direction. The pair of focus openings 86A and 86B overlying portions 54A and 54B of that electron-emissive region 54 are, as a group, also offset in the positive column direction relative to that region 54. The spacing from the composite center of portions 54A and 54B of that region 54 to the composite center of the overlying pair of openings 86A and 86B is at non-zero offset value $d_{EFCR}$ in the positive column direction.

FIGS. 9 and 10 show that offset spacing $d_{EFCR}$ is less than offset spacing $d_{ELCR}$. Consequently, the just-mentioned electron-emissive region 54 is closer to the left-hand side of the overlying pair of focus openings 86A and 86B than to their right-hand side. The electrons emitted by portions 54A and 54B of that region 54 are thus, on the average, diverted slightly in the positive column direction to compensate for the lateral offset of corresponding light-emissive region 64 to that electron-emissive region 54 in the positive column direction. Similar to what occurs in the FED of FIGS. 5 and 6, offset spacing $d_{EFCL}$ or $d_{EFCR}$ of each pair of openings 86A and 86B to (portions 54A and 54B of) underlying region 54 is in the same absolute (negative or positive column) direction as, but at a lesser magnitude than, offset spacing $d_{ELCL}$ or $d_{ELCR}$ of corresponding light-emissive region 64 to that electron-emissive region 54.

The spacing from the composite center of the pair of focus openings 86A and 86B respectively overlying portions 54A and 54B of one of the first, more narrowly separated, pairs of electron-emissive regions 54 to the composite center of the adjoining pair of openings 86A and 86B respectively overlying portions 54A and 54B of the other of that first pair of regions 54 is focus spacing $S_{FC1}$. In light of the foregoing offsets of openings 86A and 86B to portions 54A and 54B of underlying regions 54, center-to-center focus spacing $S_{FC1}$ is the sum of center-to-center electron-emission spacing $S_{EC1}$ and offset spacings $d_{EFCL}$ and $d_{EFCR}$. Center-to-center electron-emission spacing $S_{EC1}$ is thus again less than center-to-center focus spacing $S_{FC1}$. That is, each first pair of regions 54 is at a less center-to-center spacing in the column direction than the two overlying pairs of openings 86A and 86B.

The opposite arises with each second, more widely separated, pair of electron-emissive regions 54 and the two overlying pairs of focus openings 86A and 86B. The spacing from the composite center of the pair of openings 86A and 86B respectively overlying portions 54A and 54B of one of the two pairs of regions 54 to the composite center of the adjacent pair of openings 86A and 86B respectively overlying portions 54A and 54B of the other of that pair of regions 54 is focus spacing $S_{FC2}$. Center-to-center electron-emission spacing $S_{EC2}$ is the sum of center-to-center focus spacing $S_{FC2}$ and offset spacings $d_{EFCR}$ and $d_{EFCL}$. Accordingly, center-to-center electron-emission spacing $S_{EC2}$ is again greater than center-to-center focus spacing $S_{FC2}$. Hence, each second pair of regions 54 is at a greater center-to-center spacing in the column direction than the two overlying pairs of openings 86A and 86B.

In addition to being positioned to compensate for the column-direction offsets of light-emissive regions 64 relative to electron-emissive regions 54 in the FED of FIGS. 9 and 10, focus openings 86A and 86B are positioned relative to electron-emissive portions 54A and 54B so as to flatten the column-direction profile of the intensity at which electrons emitted by regions 54 strike corresponding light-emissive regions 64 and thereby reduce the effect of column-direction electron deflections caused by the presence of spacer walls 64 as described above in connection with the display of FIGS. 7 and 8. Achieving the desired electron-intensity profile flattening generally requires that the pair of openings 86A and 86B overlying portions 54A and 54B of each electron-emissive region 54 be shifted away from each other relative to that pair of portions 54A and 54B. That is, one of each pair of openings 86A and 86B is shifted in the negative column direction relative to the underlying one of the corresponding pair of portions 54A and 54B while the other of that pair of openings 86A and 86B is shifted in the positive column direction relative to the other of the corresponding pair of portions 54A and 54B.

Compensating solely for the column-direction offsets of light-emissive regions 64 to electron-emissive regions 54 in the FED of FIGS. 9 and 10 requires that focus openings 86A and 86B of each pair be shifted in the same (negative or positive) column direction relative to respectively underlying electron-emissive portions 54A and 54B. Hence, the overall shift in the column-direction position for one of openings 86A and 86B in each pair relative to the underlying one of the corresponding pair of portions 54A and 54B is an additive combination of a shift for offset compensation and a (same-direction) shift for electron-intensity profile flattening, whereas the overall shift in the column-direction position for the other of openings 64A and 64B in that pair relative to the underlying one of the other of the corresponding pair of portions 54A and 54B is a subtractive, partially canceling, combination of a shift for offset compensation and a (reverse-direction) shift for electron-intensity profile flattening. FIGS. 9 and 10 illustrate an example of the resultant overall shifts in the negative and positive column directions.

Analogous to what was said above about the display of FIGS. 3 and 4, each column of light-emissive regions 64 in the FED of FIGS. 9 and 10 is situated substantially opposite the corresponding column of electron-emissive regions 54 formed with portions 54A and 54B. In other words, each light-emissive region 64 in the FED of FIGS. 9 and 10 is not significantly laterally offset from corresponding electron-emissive region 54 in the row direction. Consequently, each pair of focus openings 86A and 86B are not significantly offset from portions 54A and 54B of underlying region 54 in the row direction.

Light-emitting device 42 and spacer walls 46 in the FED of FIGS. 9 and 10 are configured and operable largely the same as in the FED of FIGS. 5 and 6. Electrons emitting by portions 54A and 54B of electron-emissive regions 54 thus pass through light-reflective anode layer 88 before striking light-emissive regions 64. Each spacer wall 46 in the FED of FIGS. 9 and 10 contacts electron-focusing system 76 at a location centered above the space between two consecutive rows of focus openings 86A respectively overlying portions 54A of one of the second pairs of consecutive rows of regions 54.

Implementing each electron-emissive region 54 with two portions 54A and 54B in the manner shown in FIGS. 9 and 10 typically permits each region 54 to have an increased total amount of lateral area for emitting electrons. The magnitude of the voltage range across which regions 54 operate can thereby be reduced.

Figure 11:
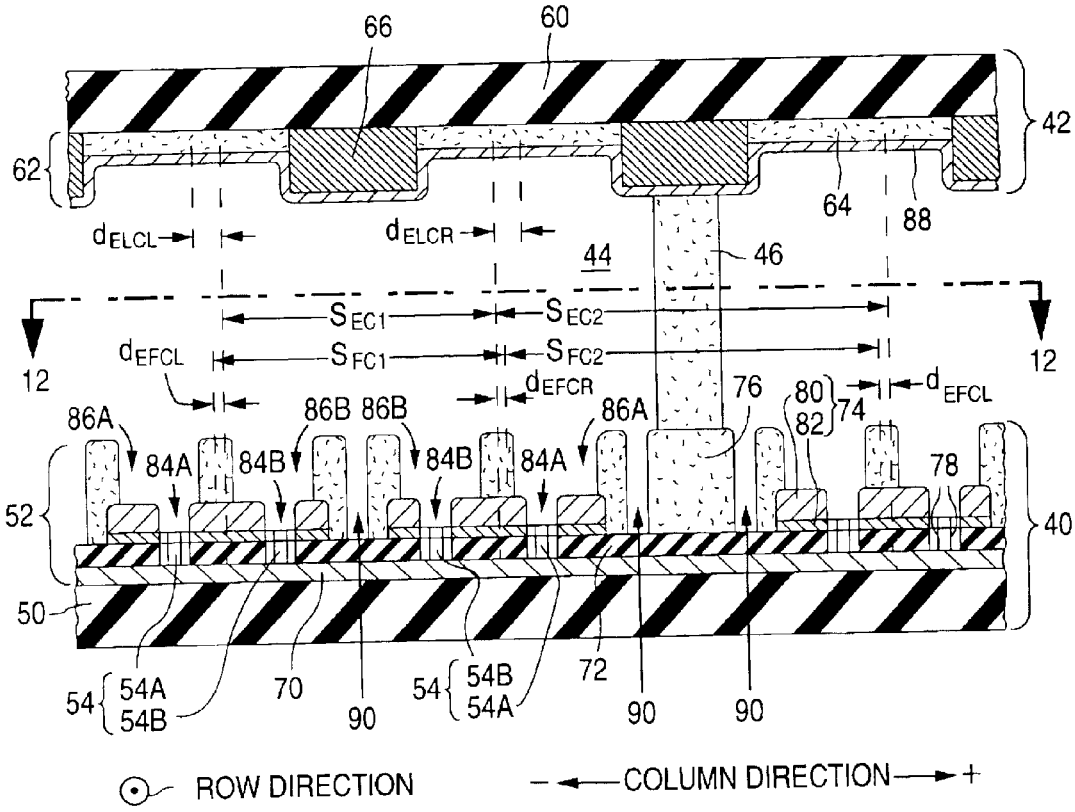
FIG. 11 is a cross-sectional side view of part of the active region of another field-emission implementation of the inventive flat-panel display of FIG. 7.
Figure 12:
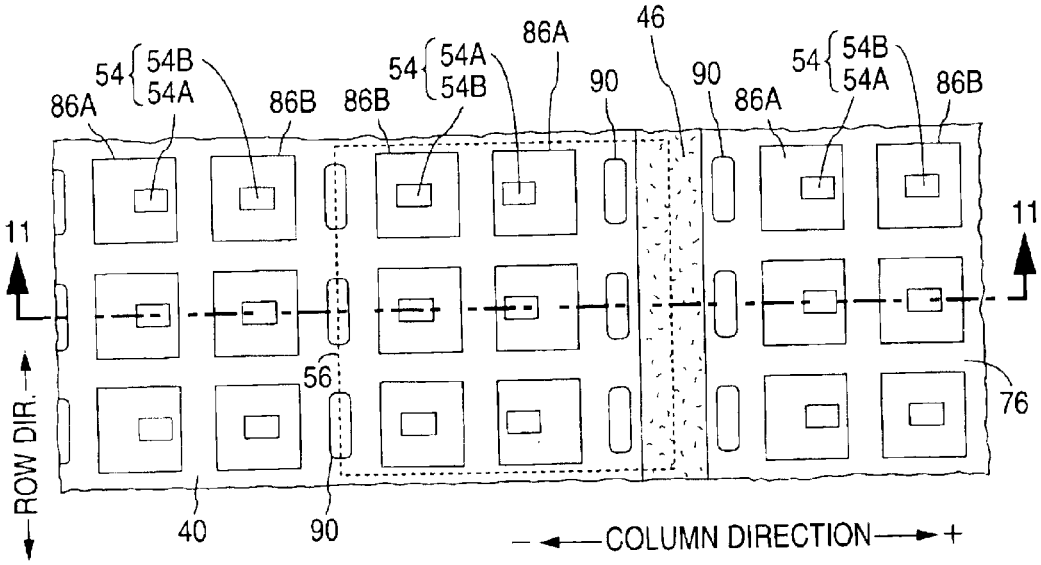
FIG. 12 is a cross-sectional plan view of part of the active region of the field-emission implementation of FIG. 11. The cross section of FIG. 11 is taken through plane 11—11 in FIG. 12. The cross section of FIG. 12 is taken through plane 12—12 in FIG. 11.

FIGS. 11 and 12 respectively present side and plan-view cross sections of part of the active region of another field-emission implementation of the flat-panel CRT display of FIGS. 5 and 6 in accordance with the invention. The cross section of FIG. 10 is taken in the same way as the cross section of FIG. 8. FIG. 10 thus largely illustrates a plan view of part of the active portion of electron-emitting device 40.

The FED of FIGS. 11 and 12 is identical to the FED of FIGS. 9 and 10 except that additional openings 90 extends through electron-focusing system 76 down to dielectric layer 72 in the FED of FIGS. 9 and 10. Additional openings 90 provides stress relief to system 76, thereby causing its upper surface to be flatter. As viewed perpendicular to faceplate 50, one row of openings 90 lies between each first, more narrowly separated, pair of consecutive rows of electron-emissive regions 54. Two rows of openings 90 lie between each second, more widely separated, pair of consecutive rows of regions 54.

The FED of FIGS. 11 and 12 has the following lateral dimensions. Each of offset spacings $d_{ELCL}$ and $d_{ELCR}$ is 2–50 $\mu$m , typically 15–20 $\mu$m. Center-to-center electron-emission spacing $S_{EC1}$ is 150–400 $\mu$m, typically 220–240 $\mu$m. Center-to-center electron-emission spacing $S_{EC2}$ is 200–500 $\mu$m, typically 310–330 $\mu$m. Each of offset spacings $d_{EFCL}$ and $d_{EFCR}$ is 1–20 $\mu$m, typically 5 $\mu$m. Hence, center-to-center focus spacing $S_{FC1}$ is approximately 150–440 $\mu$m, typically 230–250 $\mu$m while center-to-center focus spacing $S_{FC2}$ is approximately 160–460 $\mu$m, typically 300–320 $\mu$m.

Additionally, the dimension of each electron-emissive portion 54A or 54B is 20–60 $\mu$m, typically 30–35 $\mu$m, in the column direction. Each portion 54A or 54B has a dimension of 5–30 $\mu$m, typically 10–15 $\mu$m, in the row direction. The dimension of each focus openings 86A or 86B is 50–150 $\mu$m, typically 90 $\mu$m, in the column direction. Each openings 86A or 86B has a dimension of 40–120 $\mu$m, typically 80 $\mu$m, in the row direction. With focus openings 86A and 86B being respectively centered on underlying portions 54A and 54B in the row direction, the spacing between each pair of openings 86A or 86B in the row direction is 50–150 $\mu$m, typically 90–95 $\mu$m.

Flat-panel Display Having Concentrated Electron Focusing

Figure 13:
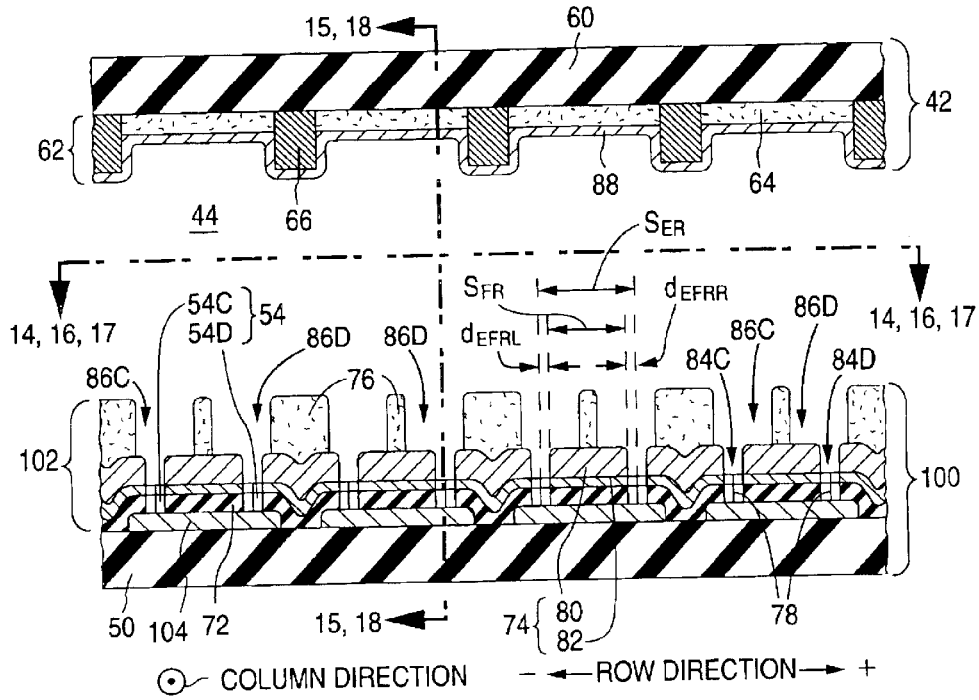
FIG. 13 is a cross-sectional side view of part of the active region of a field-emission flat-panel CRT display that provides concentrated electron focusing according to the invention.
Figure 14:
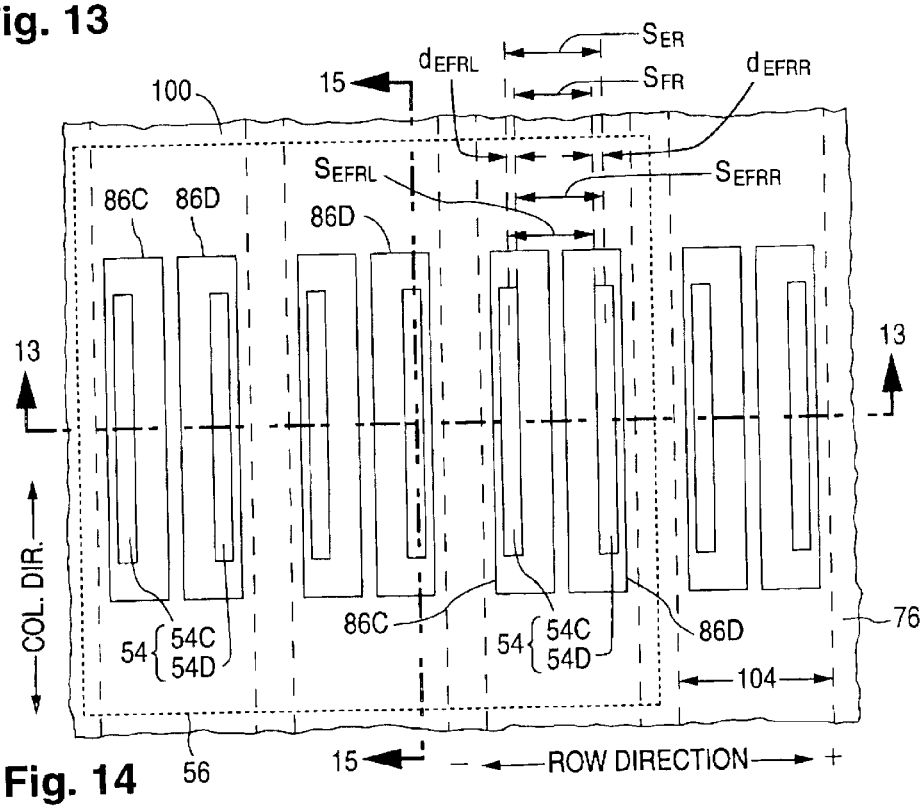
FIG. 14 is a cross-sectional plan view of part of the active region of the flat-panel display, specifically the electron-emitting device, of FIG. 13.
Figure 15:
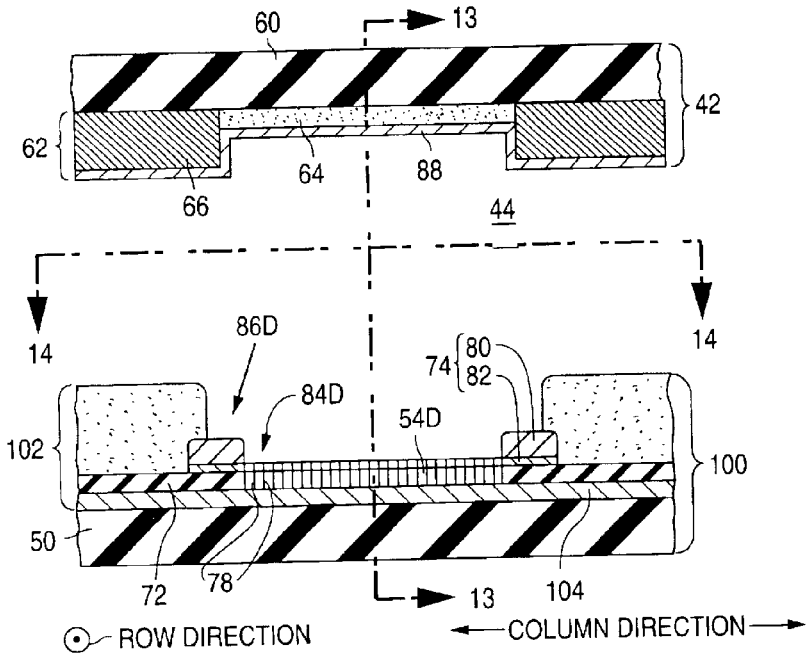
FIG. 15 is another cross-sectional side view of part of the active region of the flat-panel display of FIGS. 13 and 14. The cross section of FIG. 13 is taken through plane 13—13 in FIGS. 14 and 15. The cross section of FIG. 14 is taken through plane 14—14 in FIGS. 13 and 15. The cross section of FIG. 15 is taken through plane 15—15 in FIGS. 13 and 14.

FIGS. 13–15 respectively illustrate side, plan-view, and side cross sections of part of the active region of a field-emission flat-panel CRT display which provides highly concentrated electron focusing in accordance with the invention. The cross sections of FIGS. 13 and 15 are taken perpendicular to each other. The cross section of FIG. 13 depicts how the active portion of this field-emission display appears in the column direction. Analogous to the cross sections of FIGS. 3, 5, 7, 9, and 11, the cross section of FIG. 15 depicts how the active portion of the FED appears in the row direction.

The FED of FIGS. 13–15 contains an electron-emitting device 100 and oppositely situated light-emitting device 42. Devices 100 and 42 are connected together through an outer wall (not visible here) to form sealed enclosure 44 maintained at a high vacuum, again typically an internal pressure of no more than approximately $10^{-6}$ torr. The plan-view cross section of FIG. 14 is taken in the direction of electron-emitting device 100 along a plane extending through enclosure 44. As a result, FIG. 14 largely presents a plan view of part of the active portion of device 100.

A spacer system may be situated between devices 100 and 42 for resisting external forces exerted on the FED and for maintaining a relatively uniform spacing between devices 100 and 42. Unlike the displays of FIGS. 3–12, the spacer system does not significantly affect the highly concentrated electron focusing provided in the FED of FIGS. 13–15. For simplicity, the spacer system is not shown in any of FIGS. 13–15. When present, the spacer system typically consists of a group of largely parallel spacer walls, analogous to above-described spacer walls 46 extending in the row direction.

Electron-emitting device, or faceplate structure, 100 is formed with faceplate 50 and a group of layers and regions 102 situated over the interior faceplate surface. Layers/regions 102 include a lower electrically non-insulating region, dielectric layer 72, control electrodes 74, electron-emissive regions 54 arranged in generally straight rows and columns, and electron-focusing system 76.

The lower non-insulating region lies on backplate 50 and includes a group of emitter electrodes 104 extending generally parallel to one another in the column direction. The lower non-insulating region also includes an electrically resistive layer which lies on emitter electrodes 104 and, depending on its shape, may extend down to backplate 50 in the spaces between electrodes 104. The resistive layer is, for simplicity, not explicitly indicated in any of FIGS. 13–15. At the minimum, the resistive layer underlies electron-emissive regions 54. Dielectric layer 72 lies on the lower non-insulating region and, dependent on the shape of the resistive layer, may extend down to backplate 50 in the spaces between electrodes 104. Although FIGS. 13 and 15 depict dielectric layer 72 as lying directly on electrodes 104, the resistive layer lies at least partly between layer 72, on one hand, and electrodes 104, on the other hand.

Each electron-emissive region 54 in the FED of FIGS. 13–15 consists of a pair of electron-emissive portions 54C and 54D laterally separated in the row direction in accordance with the invention. In FIGS. 13 and 14, electron-emissive portion 54C forms the left-hand part of each region 54 while electron-emissive portion 54D forms the right-hand part of each region 54. Each of portions 54C and 54D is formed with multiple electron-emissive elements 72 situated largely in openings (not explicitly shown) extending through dielectric layer 72. Electron-emissive elements 78 of each portion 54C or 54D are situated on a portion of the resistive layer. Each element 78 again typically consists of a cone or a filament.

Each row of electron-emissive regions 54 consists of electron-emissive portions 54C alternating with electron-emissive portions 54D. Each column of regions 54 consists of a column of portions 54C and an adjoining column of portions 54D. The columns of regions 54 are normally spaced largely uniformly apart from one another. The same applies to the rows of regions 54.

Electron-emissive portions 54C and 54D can be configured laterally in various ways. Portions 54C are normally of largely the same size and have largely the same orientation and lateral shape. Portions 54D are likewise of largely the same size and of largely the same orientation and lateral shape. Also, portions 54D are typically of largely the same size, orientation, and lateral shape as portions 54C. Portions 54C and 54D are typically largely symmetrical about their centerlines (not shown) in both the row and column directions. In particular, portions 54C and 54D are typically laterally shaped generally as rectangles. Each rectangle is usually of greater dimension in the column direction than in the row direction.

More generally, portions 54C and 54D of each electron-emissive region 54 are normally configured to be largely mirror images of each other relative to the column direction.

As such, portions 54C and 54D of each region 54 may be asymmetrical about their centerlines in the column direction. However, portions 54C and 54D of region 54 are still typically largely symmetrical about their centerlines in the row direction. The layout of FIG. 14 is an example of the limiting case of this mirror-image arrangement in which portions 54C and 54D are largely symmetrical about their centerlines in both the row and column directions.

The center-to-center spacing between portions 54C and 54D of each electron-emissive region 54 in the row direction is largely the same for all regions 54. This center-to-center spacing is indicated as item $S_{ER}$ in FIGS. 13 and 14. As a result, the physical spacing between portions 54C and 54D of each region 54 in the row direction is largely the same for all regions 54. Also, portions 54C and 54D of each region 54 are preferably at largely zero center-to-center offset in the column direction. Hence, portions 54C and 54D of each region 54 are preferably directly opposite each other as viewed in the row direction.

As in the displays of FIGS. 3–12, control electrodes 74 lie on dielectric layer 72 and extend generally parallel to one another in the row direction. Each electrode 74 again consists of main control portion 80 and adjoining gate portion 82 arranged as described above. Although the single gate portion 82 depicted in FIG. 13 extends across the entire illustrated part of the active portion of electron-emitting device 100, each gate portion 82 may be divided into laterally separated segments, typically one for each electron-emissive region 54 controlled by associated electrode 74.

A group of main control openings 84C and 84D extend through main control portions 80 of control electrodes 74 respectively above electron-emissive portions 54C and 54D. The pair of main control openings 84C and 84D situated respectively above portions 54C and 54D of each electron-emissive region 54 are laterally separated in the row direction. Electron-emissive elements 78 of each portion 54C or 54D are exposed to enclosure 44 through openings (not explicitly shown) in gate portion 82 of associated electrode 74 at the bottom of corresponding opening 84C or 84D. The size, orientation, and lateral shape of each portion 54C or 54D is defined by overlying opening 84C or 84D.

Portions 54C and 54D of each electron-emissive region 54 overlie one emitter electrode 104 and have a pair of main control openings 84C and 84D extending through main control portion 80 of one control electrode 74. Hence, portions 54C and 54D of each region 54 are controlled together. Provided that portions 54C and 54D of each region 54 are both operative, both of portions 54C and 54D in that region 54 normally emit electrons substantially simultaneously whenever that region 54 emits electrons. Each region 54 may be deemed to include the underlying part of associated emitter electrode 104 and the overlying part of associated gate portion 82.

Electron-focusing system 76 is again situated on dielectric layer 72 and extends over control electrodes 74. A suitable focus potential is again applied to system 76 from an appropriate voltage source (not shown).

A group of focus openings 86C and 86D extend through electron-focusing system 76 down to control electrodes 74. Each focus opening 86C or 86D is located above a corresponding different one of electron-emissive portions 54C or 54D so as to fully expose that portion 54C or 54D. As viewed perpendicular to backplate 50, the lateral boundary of each portion 54C or 54D is preferably situated fully within the lateral boundary of corresponding opening 86C or 86D. Electrons emitted by each portion 54C or 54D pass through overlying opening 86C or 86D on their way to light-emitting device 42. System 76 is normally configured so that the material carrying the focus potential extends from the tops of openings 86C and 86D at least partway down into each of them.

Analogous to electron-emissive portions 54C and 54D, focus openings 86C and 86D can be configured laterally in various ways. Openings 86C are typically of largely the same size and of largely the same lateral orientation and shape. Openings 86D are likewise typically of largely the same size and of largely the same lateral orientation and shape. Also, openings 86D are typically of largely the same size, lateral orientation, and lateral shape as openings 86C. Openings 86C and 86D are typically largely symmetrical about their centerlines (not shown) in both the row and column directions. In particular, openings 86C and 86D are typically laterally shaped generally as rectangles. Each rectangle is usually of considerably greater dimension in the column direction than in the row direction.

Let a "pair" of focus openings 86C and 86D here mean two directly adjacent openings 86C and 86D that respectively expose portions 54C and 54D of an electron-emissive region 54. In general, openings 86C and 86D in each focus-opening pair are normally configured to be largely mirror images of each other relative to the column direction. As a result, openings 86C and 86D in each pair may be asymmetrical about their centerlines in the column direction. Openings 86C and 86D are, however, still typically largely symmetrical about their centerlines in the row direction. Openings 86C and 86D of each pair are typically configured in this mirror-image arrangement when portions 54C and 54D of each region 54 are configured, as described above, in a corresponding mirror-image arrangement relative to the column direction. The layout of FIG. 14 is an example of the limiting case of these two mirror-image arrangements in which, like portions 54C and 54D of each region 54, openings 86C and 86D of each focus-opening pair are largely symmetrical about their centerlines in both the row and column directions.

The center-to-center spacing between focus openings 86C and 86D of each pair in the row direction is largely the same for all the pairs of openings 86C and 86D. FIGS. 13 and 14 illustrate this center-to-center focus spacing as item $S_{FR}$. Consequently, the actual separation between openings 86C and 86D of each focus-opening pair in the row direction is largely the same for all the pairs of openings 86C and 86D. In addition, openings 86C and 86D of each pair are preferably at largely zero center-to-center offset in the column direction. Openings 86C and 86D of each pair are thus preferably directly opposite each other as viewed in the row direction.

Center-to-center spacing $S_{ER}$ between portions 54C and 54D of each electron-emissive region 54 is, in accordance with the invention, greater than center-to-center spacing $S_{FR}$ between the pair of focus openings 86C and 86D respectively overlying portions 54C and 54D of that region 54. In other words, portions 54C and 54D of each region 54 are at a greater center-to-center spacing than the pair of overlying openings 86C and 86D. As viewed in the column direction, portions 54C and 54D of each region 54 are thus laterally closer, on the average, to the most remote sides of that pair of openings 86C and 86D than to their closest sides. Due to the focus potential applied to electron focusing system 76, the electrons emitted by portions 54C and 54D of each region 54 are diverted in such a way as to converge.

More particularly, let the row direction to the right in FIGS. 13 and 14 be referred to as the positive row direction while the row direction to the left in FIGS. 13 and 14 is referred to as the negative row direction. Three basic convergence scenarios can arise. In the primary convergence scenario discussed further below, electrons emitted from portion 54C of each electron-emissive region 54 are diverted slightly in the positive row direction. Electrons emitted from portion 54D of that region 54 are diverted slightly in the negative row direction so as to converge with the electrons emitted from portion 54C of that region 54. The convergence occurs above electron-emitting device 40 along a narrow location extending in the column direction. The convergence location overlies portions 54C and 54D of that region 54, including the space between those two portions 54C and 54D.

In one of the two remaining convergence scenarios, the electrons emitted by portion 54C of each electron-emissive region 54 are diverted slightly in the negative row direction. The electrons emitted from portion 54D of that region 54 are diverted slightly more in the negative row direction so as to converge with the electrons emitted from portion 54C of that region 54. The last convergence scenario is the inverse of the second-mentioned convergence scenario in which electrons emitted from portions 54C and 54D of each region 54 converge after being diverted in the positive row direction.

Regardless of which of the three convergence scenarios arises, configuring focus openings 86C and 86D relative to portions 54C and 54D in the preceding manner causes electron-focusing system 76 to function like a converging lens. More particularly, openings 86C and 86D of each pair act like individual converging lenses which converge at largely the same location.

Each electron-emissive portion 54C and overlying focus opening 86C are at a center-to-center offset spacing $d_{EFRL}$ in the row direction. Offset spacing $d_{EFRL}$ is positive when the center of that portion 54C is farther (more distant) in the negative column direction (more to the left in FIGS. 13 and 14) than the center of overlying opening 86. Each electron-emissive portion 54D and overlying focus opening 86D are at a center-to-center offset spacing $d_{EFRR}$ in the row direction. Offset spacing $d_{EFRR}$ is positive when the center of that portion 54D is farther in the positive column direction (more to the right in FIGS. 13 and 14) than the center of overlying opening 86D.

Offset spacings $d_{EFRL}$ and $d_{EFRR}$ are typically both positive. In that case, the first-mentioned convergence scenario arises in which electrons emitted by portion 54C of each electron-emissive region 54 are diverted slightly in the positive row direction to converge with electrons which are emitted by portion 54D of that region 54 and are diverted slightly in the negative row direction. Spacings $d_{EFRL}$ and $d_{EFRR}$ are preferably positive and largely equal. Electrons emitted by portions 54C and 54D of each region 54 then converge on a location which, as viewed perpendicular to backplate 50, is largely centered between portions 54C and 54D of that region 54.

Referring to FIG. 14, portion 54C of each electron-emissive region 54 and focus opening 86D overlying portion 54D of that region 54 are at a center-to-center spacing $S_{EFRL}$. Portion 54D of that region 55 and focus opening 86C overlying portion 54C of that region 54 are at a center-to-center spacing $S_{EFRR}$. Center-to-center spacing $S_{EFRL}$ equals the sum of center-to-center focus spacing $S_{FR}$ and offset spacing $d_{EFRL}$. Center-to-center spacing $S_{EFRR}$ similarly equals the sum of center-to-center focus spacing $S_{FR}$ and offset spacing $d_{EFRR}$. The condition that offset spacings $d_{EFRL}$ and $d_{EFRR}$ both be positive is thus equivalent to the condition that each of center-to-center spacings $S_{EFRL}$ and $S_{EFRR}$ be greater than center-to-center focus spacing $S_{FR}$, thereby leading to the first-mentioned convergence scenario in which electrons emitted by portions 54C and 54D of each region 54 converge on a narrow location extending in the column direction and, as viewed perpendicular to backplate 50, situated laterally between portions 54C and 54D of that region 54, including the intervening space.

The condition that offset spacings $d_{EFRL}$ and $d_{EFRR}$ be positive and largely equal can be replaced by the condition that center-to-center spacings $S_{EFRL}$ and $S_{EFRR}$ be largely the same and greater than center-to-center focus spacing $S_{FR}$. Accordingly, electrons emitted by portions 54C and 54D of each electron-emissive region 54 converge in a generally symmetrical manner at a location directly above the composite center of portions 54C and 54D of that region 54.

Light-emitting device 42 here consists of backplate 60, light-emissive regions 64, black matrix 66, and light-reflective anode layer 88 configured and operable as described above in connection with the displays of FIGS. 3–6. Layer 88 can be replaced with a transparent anode layer situated between faceplate 60, on one hand, and components 64 and 66, on the other hand. The columns of light-emissive regions 64 are again spaced largely equally apart from one another. The same applies to the rows of regions 64. Each region 64 is situated largely directly opposite a corresponding different one of electron-emissive regions 54.

Subject to changes that arise from implementing each electron-emissive region 54 as portions 54C and 54D, the FED of FIGS. 13–15 operates in basically the same manner as the displays of FIGS. 3–6. With light-emissive regions 64 situated respectively opposite electron-emissive regions 54, offset spacings $d_{EFRL}$ and $d_{EFRR}$ are preferably chosen to be positive and largely equal. Center-to-center spacings $S_{ER}$ and $S_{FR}$ are set at values which cause electrons emitted by portions 54C and 54D of each electron-emissive region 54 to converge generally on oppositely situated light-emissive region 64. Since offset spacings $d_{EFRL}$ and $d_{EFRR}$ are largely equal, the electron convergence occurs at a narrow location roughly centered on each region 64 relative to the row direction so as to concentrate the electron focusing.

By concentrating the electron focusing in the preceding way, the average distance between electron-emitting device 100 and light-emitting device 42 can be increased. This permits the electrical potential applied to anode layer 88 to be increased. By operating at a higher anode potential, the display of FIGS. 13–15 operates more efficiently and lasts longer. With increased spacing between devices 100 and 42, the average electric field in sealed enclosure 44 can be reduced to decrease the likelihood of electrical arcing. Display reliability is enhanced.

The display of FIGS. 13–15 may include getter material for sorbing contaminant gases. When the getter is located outside the display's active region, increasing the spacing between electron-emitting device 100 and light-emitting device 42 enables contaminant gases to travel more readily from their originating locations in the active region to the getter material. Consequently, the getter material is able to sorb contaminant gases more efficiently.

Also, the layout of FIG. 14 permits the total amount of lateral area per electron-emissive region 54 to be increased. As a result, electron-emissive regions 54 can be operated across a reduced switching voltage range.

Flat-panel Display Having Focus-opening Offsets in Row and Column Directions

Figure 16:
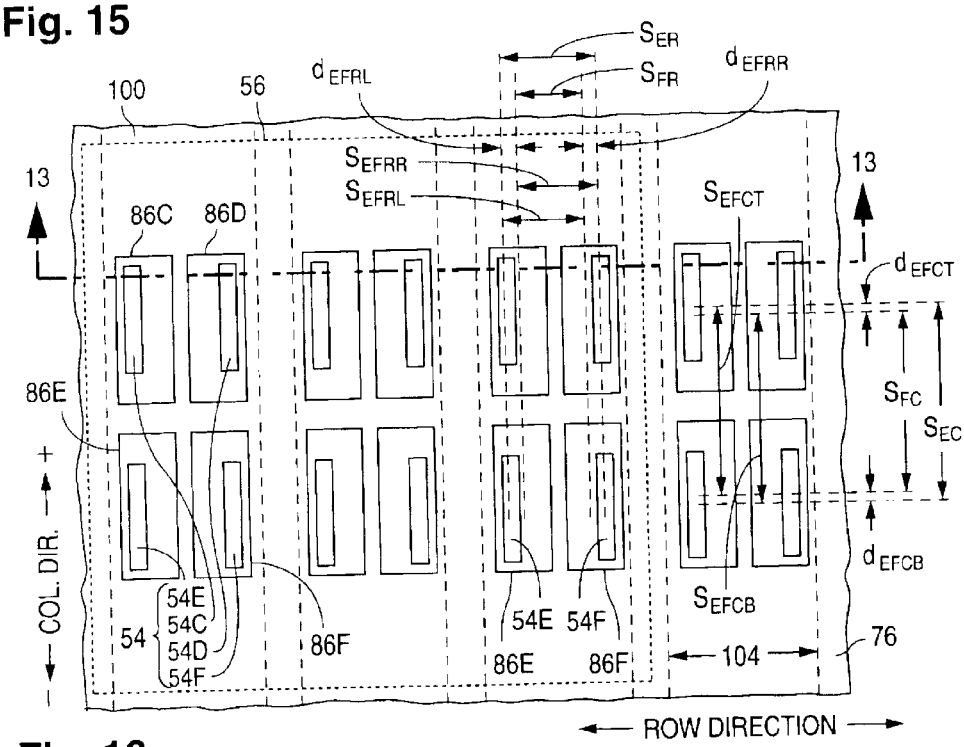
FIG. 16 is a cross-sectional plan view of part of the active region of an extension of the field-emission flat-panel CRT display, specifically the electron-emitting device, of FIGS. 13–15 according to the invention. The side cross section of FIG. 13 is also a side cross section of part of the active region of the flat-panel display of FIG. 16 and is taken through plane 13—13 in FIG. 16. The cross section of FIG. 16 is taken through plane 16—16 in FIG. 13.

FIG. 16 presents a plan-view cross section of part of the active portion of the electron-emitting device of a field-emission flat-panel CRT display that provides highly concentrated electron focusing in orthogonal lateral directions in accordance with the invention. The FED of FIG. 16 is an extension of the FED of FIGS. 13–15. The side cross section of FIG. 13 is also a side cross section of part of the active region of the FED of FIG. 16.

The FED of FIGS. 13 and 16 contains electron-emitting device 100 and light-emitting device 42 configured and operable as generally described above for the FED of FIGS. 13–15 except that each electron-emissive region 54 in the FED of FIGS. 13 and 16 contains four electron-emissive portions consisting of portions 54C and 54D, referred to here as the primary electron-emissive portions, and a pair of additional electron-emissive portions 54E and 54F. Aside from configuring each region 54 as portions 54C–54F and the consequent effect of configuring regions 54 in this manner, the FED of FIGS. 13 and 16 operates substantially the same as the FED of FIGS. 13 and 15.

As with primary electron-emissive portions 54C and 54D, each of additional electron-emissive portions 54E and 54F is formed with multiple electron-emissive elements situated largely in openings extending through dielectric layer 72. A group of additional main control openings (not shown here) extend through main control portions 80 of control electrode 74 respectively above additional portions 54E and 54F. Electron-emissive elements 78 of each of portions 54E and 54F are exposed to enclosure 44 through openings (likewise not shown) in gate portion 82 of associated electrode 74 at the bottom of the corresponding main control opening. The size, orientation, and lateral shape of each portion 54E or 54F is defined by the overlying main control opening. Hence, portions 54E and 54F are structured and organized largely the same as portions 54C and 54D.

Portions 54C–54F of each electron-emissive region in the FED of FIGS. 13 and 16 are arranged in a two-by-two array. As in the FED of FIGS. 13–15, primary portions 54C and 54D of each region 54 in the FED of FIGS. 13 and 16 are situated in a line extending in the row, or principal, direction and are laterally separated in the row direction. Additional portions 54E and 54F of each region 54 are situated in another line extending in the row direction and thus extend parallel to the line formed with primary portions 54C and 54D of that region 54. Additional portions 54E and 54F of each region 54 are laterally separated in the row direction by largely the same spacing as primary portions 54C and 54D of that region 54.

Portions 54C and 54E of each electron-emissive region are situated in a line extending in the column, or further, direction and are laterally separated in the column direction. Portions 54D and 54F of each region 54 are situated in another line extending in the column direction and thus extend parallel to the line formed with portions 54C and 54E of that region 54. Portions 54D and 54F of each region 54 are laterally separated in the column direction by largely the same spacing as portions 54C and 54E of that region 54.

Electron-emissive portions 54C–54F are configured laterally in generally the manner described above for portions 54C and 54D in the FED of FIGS. 13–15. Since portions 54C and 54D of each electron-emissive region 54 are normally configured as largely mirror images of each other relative to the column direction, portions 54E and 54F of each region 54 are normally configured to be largely mirror images of each other relative to the column direction. As with portions 54C and 54D of each region 54, portions 54E and 54F of each region 54 may be asymmetrical about their centerlines (not shown) in the column direction. Analogous to portions 54C and 54D of each region 54, portions 54E and 54F of each region 54 are then normally largely symmetrical about their centerlines (also not shown) in the row direction.

The presence of additional electron-emissive portions 54E and 54F may impose further constraints on the lateral configurations of primary electron-emissive portions 54C and 54D. For instance, portions 54E and 54F of each electron-emissive region 54 are normally respectively mirror images of portions 54C and 54D in that region 54. Consequently, portions 54C–54F of each region 54 are normally in a mirror-image arrangement in both the row and column directions. The layout of FIG. 16 is the limiting case of the orthogonal-direction mirror-image arrangement in which portions 54C–54F of each region 54 are laterally symmetrical about their centerlines in both the row and column directions.

In light of the preceding symmetry, the center-to-center spacing between additional portions 54E and 54F of each electron-emissive region 54 in the row direction is largely the same for all regions 54 and largely equals spacing $S_{ER}$, the center-to-center spacing between primary portions 54C and 54D of each region 54 in the row direction. The center-to-center spacing between portions 54C and 54E of each region 54 in the column direction is largely the same for all regions 54. This center-to-center spacing is indicated as item $S_{EC}$ in FIG. 16. The center-to-center spacing between portions 54D and 54F of each region 54 in the column direction is likewise largely the same for all regions 54 and largely equals spacing $S_{EC}$.

A group of additional focus openings 86E and 86F extend through electron-focusing system 76 down to control electrodes 74 in the FED of FIGS. 13 and 16. Each additional focus opening 86E or 86F is located above a corresponding different one of additional electron-emissive portions 54E or 54F so as to fully expose that portion 54E or 54F. Referring to FIG. 16, the lateral boundary of each additional portion 54E or 54F is preferably situated fully within the lateral boundary of corresponding additional opening 86E or 86F as viewed perpendicular to backplate 50. Electrons emitted by each portion 54E or 54F pass through overlying opening 86E or 86F on their way to light-emitting device 42. Openings 86E and 86F are thus positioned relative to portions 54E or 54F in largely the same way that focus openings 86E and 86D are positioned relative to electron-emissive portions 54C and 54D.

Analogous to electron-emissive portions 54C–54F, focus openings 86C–86F are configured laterally in generally the manner described above for openings 86C and 86D in the FED of FIGS. 13–15. Let a quartet of openings 86–86F mean four openings 86C–86F that respectively overlie portions 54C–54F of each electron-emissive region 54. Each quartet of openings 86C–86F thus consists of a pair, or primary pair, of openings 86C and 86D and an additional pair of openings 86E and 86F.

With focus openings 86C and 86D of each focus-opening quartet normally being configured to be largely mirror images of each other relative to the column direction, focus openings 86E and 86F of each quartet are likewise normally configured to be largely mirror images of each other relative to the column direction. As with openings 86E and 86D of each quartet, openings 86E and 86F of each quartet may be asymmetrical about their centerlines (not shown) in the column direction. Openings 86E and 86F of each quartet are, however, normally largely symmetrical about their centerlines (not shown) in the row direction.

The presence of additional focus openings 86E and 86F may impose further constraints on the lateral configurations of focus openings 86C–86F. For instance, additional openings 86E and 86F of each quartet are normally respectively mirror images of primary openings 86C and 86D of that quartet. Accordingly, openings 86C–86F of each quartet are normally in a mirror-image arrangement in both the row and column directions. Openings 86C–86F are normally in such an orthogonal-direction mirror-image arrangement when portions 54C–54F of each electron-emissive region 54 are in a corresponding orthogonal-direction mirror-image arrangement. The layout of FIG. 16 is the limiting case of the orthogonal-direction double mirror-image arrangement in which, like portions 54C–54F of each region 54, openings 86C–86F of each quartet are laterally symmetrical about their centerlines in both the row and column directions.

The center-to-center spacing between additional focus openings 86E and 86F of each quartet in the row direction is largely the same for all the quartets of focus openings 86C–86F and is largely equal to spacing $S_{FR,}$ the center-to-center spacing between primary focus openings 86C and 86D of each quartet. The center-to-center spacing between openings 86C and 86E of each quartet of openings 86c-86F in the column direction is largely the same for all the focus-opening quartets. FIG. 16 illustrates that center-to-center spacing as item $S_{FC}$. The center-to-center spacing between openings 86D and 86F of each quartet of openings 86C–86F in the column direction is largely the same for all the focus-opening quartets and largely equals spacing $S_{FC}$.

As FIG. 16 indicates, center-to-center row-direction electron-emission spacing $S_{ER}$ is greater than center-to-center row-direction focus spacing $S_{FR}$ in the display of FIGS. 13 and 16. The primary pair of portions 54C and 54D of each electron-emissive region 54 is thus at a greater center-to-center spacing than the primary pair of overlying focus openings 86C and 86D. The electrons emitted by portions 54C and 54D of each region 54 thus converge in the manner described above. The additional pair of portions 54E and 54F of each region 54 are likewise at a greater center-to-center spacing than the additional pair of overlying focus openings 86E and 86F. For the reasons presented above in connection with the FED of FIGS. 13–15, the electrons emitted by portions 54E and 54F of each region 54 also converge. Because (a) portions 54E and 54F of each region 54 are respectively aligned to portions 54C and 54D of that region 54 in the column direction and (b) openings 86E and 86F of each quartet are respectively aligned to openings 86C and 86D of that quartet in the column direction, the electrons emitted by portions 54C and 54D of each region 54 converge at a narrow location extending in the column direction generally in line with a narrow location at which the electrons emitted by portions 54E and 54F of that region 54 converge.

FIG. 16 also shows that column-direction electron-emitting spacing $S_{EC}$ is greater than column-direction focus spacing $S_{FC}$. Portions 54C and 54E of each electron-emissive region 54 are therefore at a greater center-to-center spacing than overlying focus openings 86C and 86E. Portions 54D and 54F of each region 54 are likewise at a greater center-to-center spacing than overlying focus openings 86D and 86F. For the reasons presented above, the electrons emitted by portions 54C and 54E of each region 54 converge. The electrons emitted by portions 54D and 54F of each region 54 also converge. Since (a) portions 54D and 54F of each region 54 are respectively aligned to portions 54C and 54E of that region 54 in the row direction and (b) openings 86D and 86F of each quartet are respectively aligned to openings 86C and 86E of that quartet in the row direction, the electrons emitted by portions 54C and 54E of each region 54 converge at a narrow location extending in the row direction generally in line with the narrow location at which the electrons emitted by portions 54D and 54F of that region 54 converge. Due to the electron convergence in both the row and column directions, the electrons emitted by portions 54C–54F of each region 54 converge together at a small location to produce highly concentrated electron focusing.

Electrons emitted by portion 54D of each electron-emissive region 54 can converge with electrons emitted by portion 54C of that region 54 according to any of the three convergence scenarios described above in connection with the FED of FIGS. 13–15. The same applies to the convergence of electrons emitted by portion 54F of each region 54 with electrons emitted by portion 54E of that region 54. Electrons emitted by portion 54E of each region 54 can converge with electrons emitted by portion 54C of that region 54 according to any of three convergence scenarios analogous to those described above in connection with the FED of FIGS. 13–15 but rotated by a quarter turn (90°). The same applies to the convergence of electrons emitted by portion 54F of each region 54 with electrons emitted by portion 54D of that region 54.

The manner in which electrons emitted by portions 54C–54F of each electron-emissive region 54 are diverted by electron-focusing system 76 so as to converge is determined, for the row direction, by the factors largely presented above in connection with the FED of FIGS. 13–15 and, for the column direction, by analogous factors. Each electron-emissive portion 54E and overlying focus opening 86E are at largely the same center-to-center offset spacing $d_{EFRL}$ in the row direction as each electron-emissive portion 54C and overlying focus opening 86C. Offset spacing $d_{EFRL}$ is positive when the centers of portions 54C and 54E are farther in the negative row direction than the centers of respectively overlying openings 86C and 86E. Each electron-emissive portion 54F and overlying focus opening 86F are at largely the same center-to-center offset spacing $d_{EFRR}$ in the row direction as each electron-emissive portion 54D and overlying focus opening 86D. Offset spacing $d_{EFRR}$ is positive when the centers of portions 54D and 54F are farther in the positive row direction than the centers of respectively overlying openings 86D and 86F.

Each electron-emissive portion 54C or 54D and overlying focus opening 86C or 86D are largely at a center-to-center offset spacing $d_{EFCT}$ in the column direction. Each electron-emissive portion 54E or 54F and overlying focus opening 86E or 86F are largely at a center-to-center offset spacing $d_{EFCB}$ in the column direction. Let the column direction toward the top in FIG. 16 be referred to as the positive column direction while the column direction toward the bottom in FIG. 16 is referred to as the negative column direction. Offset spacing $d_{EFCT}$ is positive when the centers of portions 54C and 54D are farther in the positive column direction (more toward the top in FIG. 16) than the centers of respectively overlying openings 86C and 86D. Offset spacing $d_{EFCB}$ is positive when the centers of portions 54E and 54F are farther in the negative column direction (more toward the bottom in FIG. 16) than the centers of respectively overlying openings 86E and 86F.

Offset spacings $d_{EFRL}$, $d_{EFRR}$, $d_{EFCT}$, and $d_{EFCB}$ are typically all positive. In that case, electrons emitted by portions 54C and 54E of each electron-emissive region 54 are diverted slightly in the positive row direction to converge with electrons which are emitted by portions 54D and 54F of that region 54 and diverted slightly in the negative row direction. Also, electrons emitted by portions 54C and 54D of each region 54 are diverted slightly in the negative column direction to converge with electrons which are emitted by portions 54E and 54F of that region 54 and diverted slightly in the positive column direction.

Row direction offset spacings $d_{EFRL}$ and $d_{EFRR}$ are preferably largely equal. Column direction offset spacings $d_{EFCT}$ and $d_{EFCB}$ are also preferably largely equal. Electrons emitted by portions 54C–54F of each electron-emissive region 54 are then diverted in such a manner as to converge on an overlying position which, as viewed perpendicular to backplate 50, is largely centered between portions 54C–54F of that region 54.

Portion 54E of each electron-emissive region 54 and focus opening 86F overlying portion 54F of that region 54 are at largely the same center-to-center spacing $S_{EFRR}$ in the row direction as portion 54C of that region 54 and focus opening 86D overlying portion 54D of that region 54. Portion 54F of each region 54 and focus opening 86E overlying portion 54E of that region 54 are similarly at largely the same center-to-center spacing $S_{EFRL}$ in the row direction as portion 54D of that region 54 and focus opening 86C overlying portion 54C of that region 54. Portion 54C or 54D of each region 54 and opening 86E or 86F overlying portion 54E or 54F of that region 54 are largely at a center-to-center spacing $S_{EFCT}$ in the column direction. Portion 54E or 54F of each region 54 and opening 86C or 86D overlying portions 54C or 54D of that region 54 are largely at a center-to-center spacing $S_{EFCB}$ in the column direction.

The condition that both of row-direction offset spacings $d_{EFRL}$ and $d_{EFRR}$ be positive is again equivalent to the condition that each of row-direction center-to-center spacings $S_{EFRL}$ and $S_{EFRR}$ be greater than row-direction center-to-center focus spacing $S_{FR}$. The condition that both of column-direction offset spacings $S_{EFCT}$ and $d_{EFCB}$ be positive is equivalent to the condition that each of column-direction center-to-center spacings $S_{EFCT}$ and $S_{EFCB}$ be greater than column-direction center-to-center focus spacing $S_{FC}$. With both of these conditions being met, electrons emitted by portions 54C–54F of each electron-emissive region 54 converge above that region 54 at a location which, as viewed perpendicular to backplate 50, is generally located within the rectangle defined by the centers of portions 54C–54F of that region 54.

As in the FED of FIGS. 13–15, the more restrictive condition that row-direction offsets spacings $d_{EFRL}$ and $d_{EFRR}$ be positive and largely equal can be replaced by the condition that row-direction spacings $S_{EFRL}$ and $S_{EFRR}$ be largely the same and greater than row-direction focus spacing $S_{FR}$. The more restrictive condition that column-direction offset spacings $d_{EFCT}$ and $d_{EFCB}$ be positive and largely equal can similarly be replaced with the condition that column-direction spacings $S_{EFCT}$ and $S_{EFCB}$ be largely the same and greater than column-direction focus spacing $S_{FC}$. Electrons emitted by portions 54C–54F of each electron-emissive region 54 thereby converge above that region 54 at a generally central location with respect to those portions 54C–54F.

Figure 17:
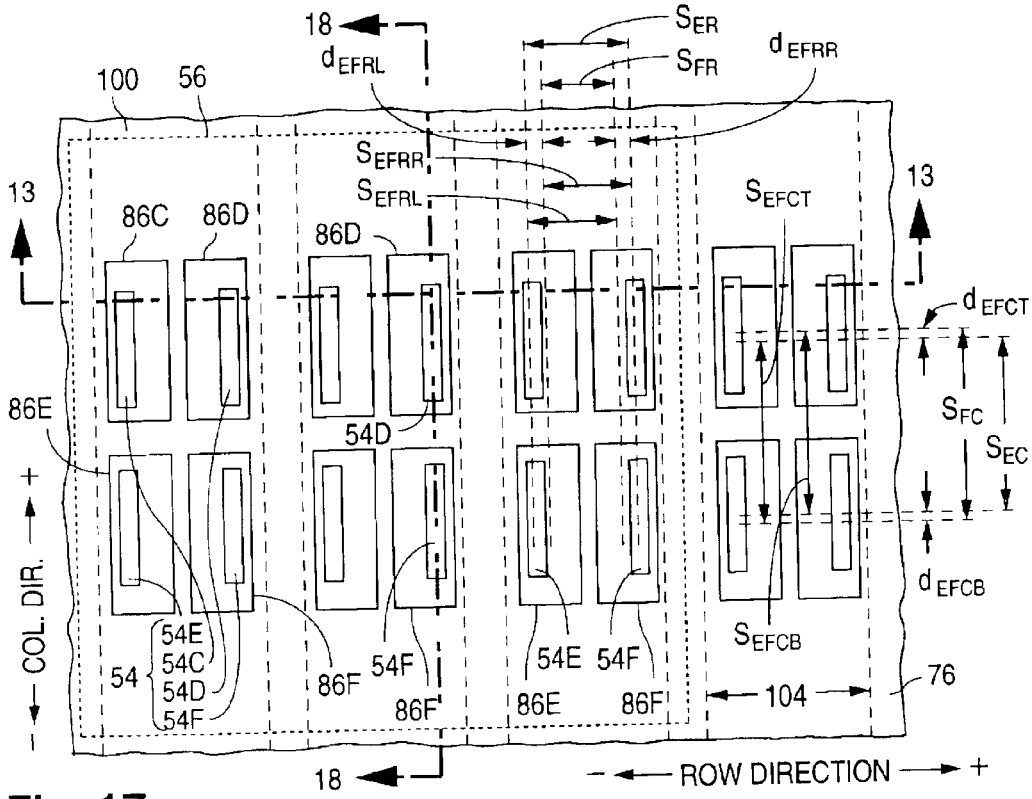
FIG. 17 is a cross-sectional plan view of part of the active region of another extension of the field-emission flat-panel CRT display, specifically the electron-emitting device, of FIGS. 13–15 according to the invention. The side cross section of FIG. 13 is also a side cross section of part of the active region of the flat-panel display of FIG. 17.
Figure 18:
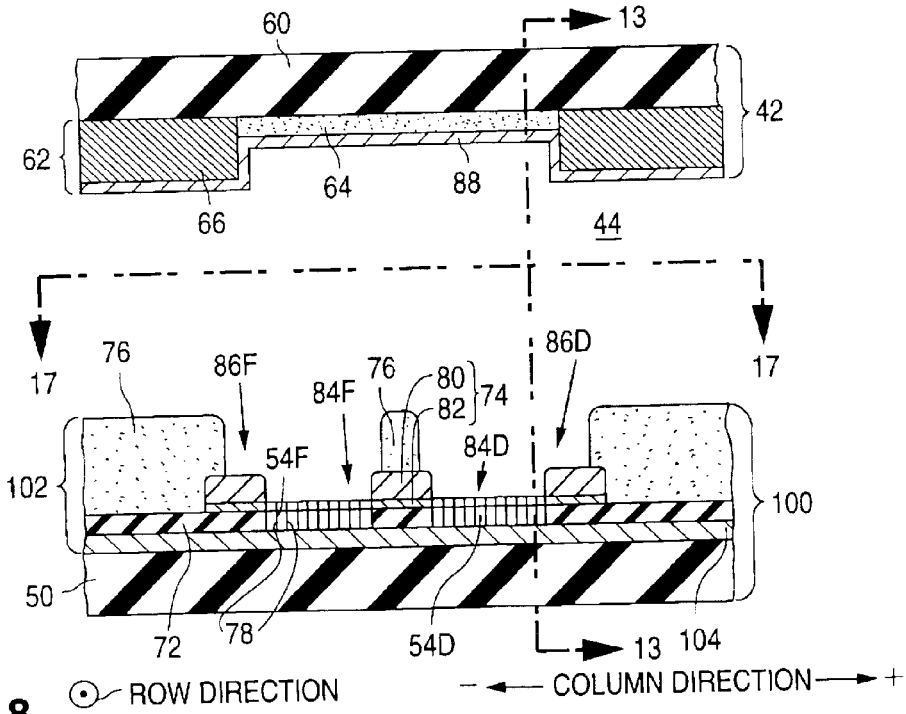
FIG. 18 is another cross-sectional side view of part of the active region of the flat-panel display of FIGS. 13 and 17. The cross section of FIG. 13 is taken through plane 13—13 in FIGS. 17 and 18. The cross section of FIG. 17 is taken through plane 17—17 in FIGS. 13 and 18. The cross section of FIG. 18 is taken through plane 18—18 in FIGS. 13 and 17.

FIG. 17 illustrates a plan view of part of the active portion of the electron-emitting device of a field-emission flat-panel CRT display which, in accordance with the invention, provides highly concentrated electron focusing in a principal direction, namely the row direction, and a considerably flattened electron-intensity striking profile in a further direction, namely the column direction, perpendicular to the principal direction. The FED of FIG. 17 is an extension of the FED of FIGS. 13–15. The side cross section of FIG. 13 is also a side cross section of part of the active region of the FED of FIG. 17. FIG. 18 presents another side cross section, taken perpendicular to the side cross section of FIG. 13, of part of the active region of the FED of FIGS. 13 and 17.

The FED of FIGS. 13, 17, and 18 contains electron-emitting device 100 and light-emitting device 42 configured and operable as generally described above for the FED of FIGS. 13 and 16 except that the lateral positioning of focus openings 86C–86F of each focus-opening quartet relative to underlying portions of 54C–54F of each electron-emissive region 54 is different. Aside from this positioning difference and the consequent effects of this positioning difference, the FED of FIGS. 13, 17, and 18 operates substantially the same as the FED of FIGS. 13 and 16. As discussed below, the FED of FIGS. 13, 17, and 18 is particularly suitable for receiving an internal spacer system such as the above-described spacer system formed with spacer walls that extend generally parallel to one another in the row direction.

Focus openings 86C–86F of each focus-opening quartet in the FED of FIGS. 13, 17, and 18 are respectively offset relative to underlying portions 54C–54F of each electron-emissive region 54 in the row direction in largely the same way as in the FED of FIGS. 13 and 16. Accordingly, the FED of FIGS. 13, 17, and 18 provides highly concentrated electron focusing in the row direction in the same manner as in the FED of FIGS. 13 and 16 and thus in largely the same manner as in the FED of FIGS. 13–15. The FED of FIGS. 13, 17, and 18 differs from the FED of FIGS. 13 and 156 in the way that openings 86C–86F of each focus-opening quartet are respectively offset relative to underlying portions 54C–54F of each region 54 in the column direction.

As indicated in FIG. 17, center-to-center focus spacing $S_{FC}$ is greater than center-to-center electron-emission spacing $S_{EC}$ rather than being less than spacing $S_{EC}$ as occurs in the FED of FIGS. 13 and 16. Accordingly, portions 54C and 54E of each electron-emission region 54 are at a lesser center-to-center spacing than overlying focus openings 86C and 86E. As viewed in the row direction, portions 54C and 54E of each region 54 are laterally closer, on the average, to the sides of respectively overlying openings 86C and 86E closest to each other than to their most remote sides. Portions 54D and 54F of each region 54 are likewise at a lesser center-to-center spacing than overlying focus openings 86D and 86F. As viewed in the row direction, portions 54D and 54F of each region 54 are similarly laterally closer, on the average, to the sides of respectively overlying openings 86D and 86F closest to each other than to their most remote sides.

Due to the focus potential applied to electron-focusing system 76, the electrons emitted by portions 54C and 54D of each electron-emissive region 54 are diverted slightly in the positive column direction. The electrons emitted by portions 54E and 54F of each region 54 are diverted slightly in the negative column direction and thus away from the electrons emitted by portions 54C and 54D of that region 54. In other words, the electrons emitted by portions 54E and 54F of each region 54 diverge from the electrons emitted by portions 54C and 54D of that region 54. This flattens the column-direction profile of the intensity at which electrons emitted by each region 54 strike oppositely situated light-emissive region 64. At the same time, the FED of FIGS. 13, 17, and 18 provides highly concentrated electron-focusing in the row direction.

By flattening the column-direction profile of the intensity at which electrons emitted by each region 54 strike oppositely situated light-emissive region 64, phenomena that cause undesired electron deflections in the row direction have less damaging effect on the light provided by regions 64. For example, spacer walls situated in the active portion of enclosure 44 and extending in the row direction often cause undesired electron deflections in the column direction.

The damaging effect that might result from undesired column-direction electron deflection caused by such spacer walls is significantly reduced in the FED of FIGS. 13, 17, and 18 because configuring focus openings 86C–86F of each quartet relative to portions 54C–54F of underlying region 58 so that center-to-center focus spacing $S_{FC}$ is greater than center-to-center electron-emission spacing $S_{EC}$ significantly negates the undesired damaging effect of such column-direction electron deflections. The FED of FIGS. 13, 17, and 18 is thus especially suitable for accommodating an internal spacer system formed with spacer walls, such as spacer walls 46, extending generally parallel to one another in the row direction.

Each light-emissive region 64 is situated largely opposite corresponding electron-emissive region 54 in the FED of FIGS. 13, 17, and 18. That is, the center of each light-emissive region 54 is at substantially zero lateral offset in both the row and column directions relative to the composite center of corresponding region 54. Accordingly, column-direction offset spacings $d_{EFCT}$ and $d_{EFCB}$ are preferably largely equal in the FED of FIGS. 13, 17, and 18. In light of how spacings $d_{EFCT}$ and $d_{EFCB}$ are defined in connection with the FED of FIGS. 13 and 16, spacings $d_{EFCT}$ and $d_{EFCB}$ are both negative in the display of FIGS. 13, 17, and 18. Spacings $d_{EFCT}$ and $d_{EFCB}$ could, alternatively, be defined so as to be positive in the FED of FIGS. 13, 17, and 18.

Figure 19:
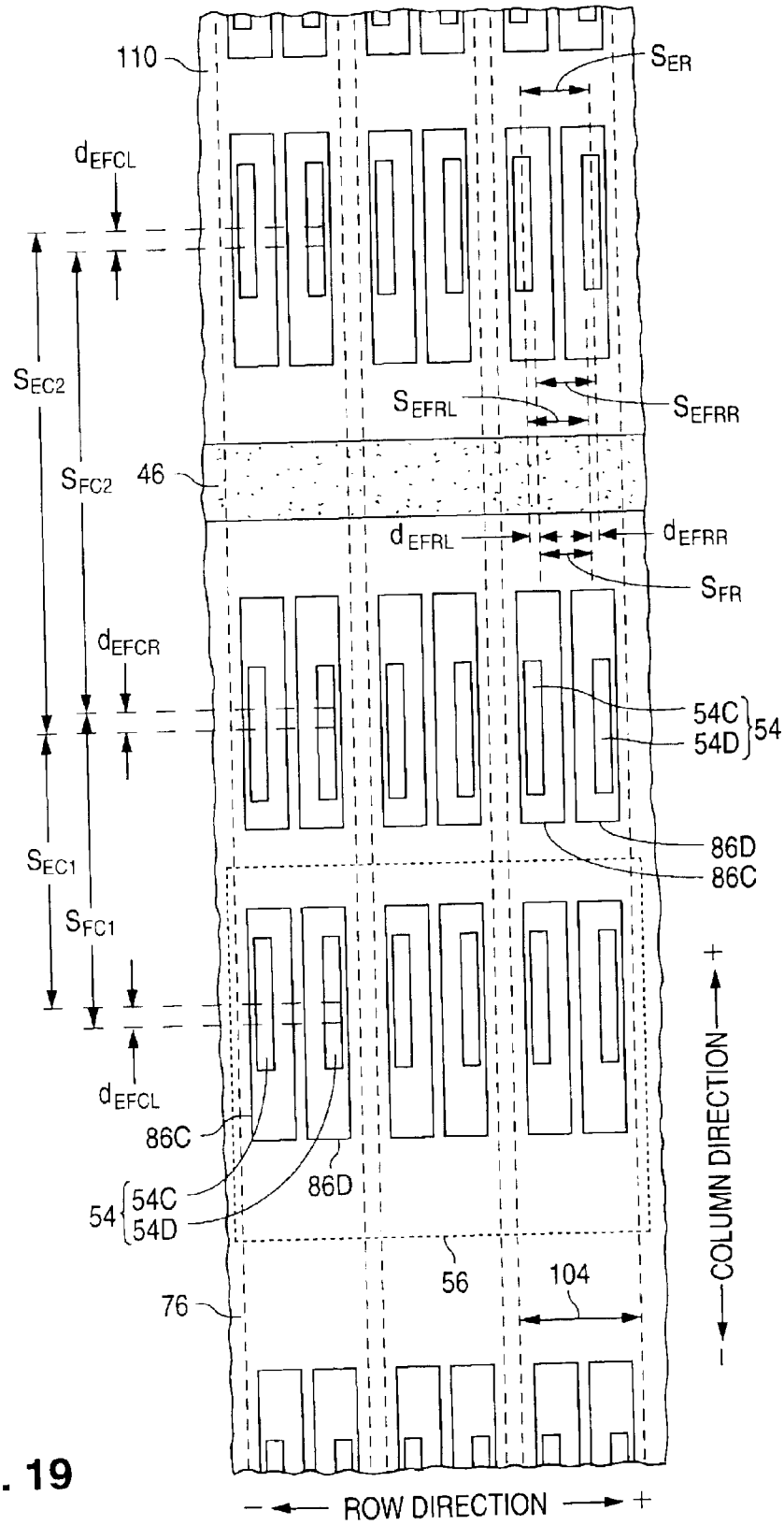
FIG. 19 is a cross-sectional plan view of part of the active portion of an extension of the electron-emitting device of the field-emission flat-panel CRT display of FIGS. 13–15 in which the rows of electron-emissive regions are spaced non-uniformly apart from one another according to the invention.

FIG. 19 presents a plan view of part of the active region of an extension 110 of electron-emitting device 100 of the field-emission flat-panel CRT display of FIGS. 13–15. As in the FED of FIGS. 13–15, an FED employing electron-emitting device 110 of FIG. 19 provides highly concentrated electron-focusing in a principal direction, namely the row direction, according to the teachings of the invention. Electron-emitting device 110 is also an extension of electron-emitting device 40 of the FED of FIGS. 5 and 6 in that electron-emissive regions situated in a line extending in a further direction, namely the column direction, perpendicular to the principal direction, are spaced non-uniformly apart from one another according to the invention's teachings.

The FED employing light-emitting device 110 contains a light-emitting device such as device 42 of FIGS. 5 and 6 or 13–15. Light-emitting device 42 interfaces with electron-emitting device 110 in the same way that device 42 interfaces with electron-emitting device 100 or 40. A spacer system consisting of spacer walls 46 extending in the row direction is situated between devices 110 and 42. FIG. 19 indicates one spacer wall 46.

Electron-emitting device 110 is configured the same as electron-emitting device 100 in the FED of FIGS. 13–15 except that the rows of electron-emissive regions 54 in device 110 are spaced non-uniformly apart from one another in the manner described above for the displays of FIGS. 3–6. Subject to each region 54 consisting of electron-emissive portions 54C and 54D in device 110, all of the teachings presented above in connection with the displays of FIGS. 3–6 apply to the FED employing device 110. Subject to the rows of regions 54 being non-uniformly spaced apart from one another and subject to the focus compensation needed to account for the non-uniform row spacing, all the teachings presented above in connection with the FED of FIGS. 13–15 also apply to the FED employing device 110.

Figure 20:
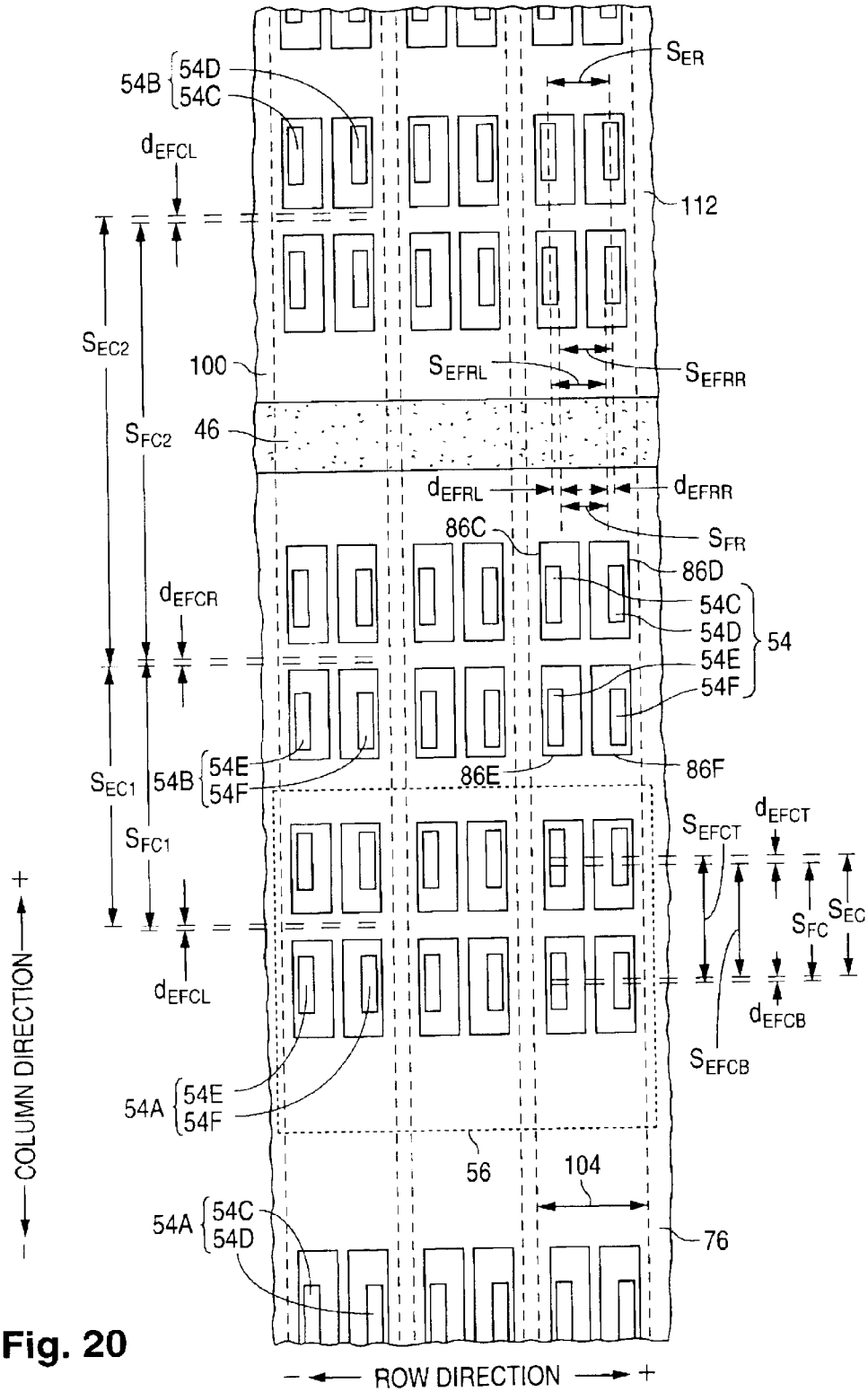
FIG. 20 is a cross-sectional plan view of part of the active portion of an extension of the electron-emitting device of the field-emission flat-panel CRT display of FIGS. 13, 17, and 18 in which the rows of electron-emissive regions are spaced non-uniformly apart from one another according to the invention.

FIG. 20 presents a plan view of part of the active portion of an extension 112 of electron-emitting device 100 of the field-emission flat-panel CRT display of FIGS. 13, 17, and 18. As in the FED of FIGS. 13, 17, and 18, an FED employing electron-emitting device 112 of FIG. 20 provides highly concentrated electron-focusing in a principal direction, again namely the row direction, according to the invention's teachings. Device 112 is also an extension of electron-emitting device 40 of the FED of FIGS. 9 and 10 in that multi-part electron-emissive regions situated in a further direction, again namely the column direction, perpendicular to the principal direction are spaced non-uniformly apart from one another in accordance with the invention.

The FED employing electron-emitting device 112 contains a light-emitting device such as device 42 of FIGS. 9 and 10 or 13, 17, and 18. Light-emitting device 42 interfaces with electron-emitting device 112 in the same manner that device 42 interfaces with electron-emitting device 100 or 40. A spacer system consisting of spacers walls 46 extending in the row direction is situated between devices 112 and 42. One spacer wall 46 is indicated in FIG. 20.

Electron-emitting device 112 is configured the same as electron-emitting device 100 in the FED of FIGS. 13, 17, and 18 except that the rows of electron-emissive regions 54 in device 112 are spaced non-uniformly from one another in the way described above for the displays of FIGS. 7–10. Subject to each region 54 consisting of electron-emissive portions 54c–54F in device 112, all of the teachings presented above in connection with the displays of FIGS. 7–10 apply to the FED employing device 112. In this regard, portion 54A of each region 54 in electron-emitting device 40 of the FED of FIGS. 9 and 10 is replaced either with a pair of portions 54C and 54D or a pair of portions 54E and 54F in device 112. In a complementary manner, portion 54B of each region 54 in device 40 of the FED of FIGS. 9 and 10 is replaced either with a pair of portions 54E and 54F or a pair of portions 54C and 54D in device 112. Subject to the rows of regions 54 being non-uniformly spaced apart from one another and subject to the focus compensation needed to account for the non-uniform row spacing, all of the teachings presented above in connection with the FED of FIGS. 13, 17, and 18 apply to the FED utilizing device 112.

Focus Structure, Display Fabrication, and Variations

Figure 21:
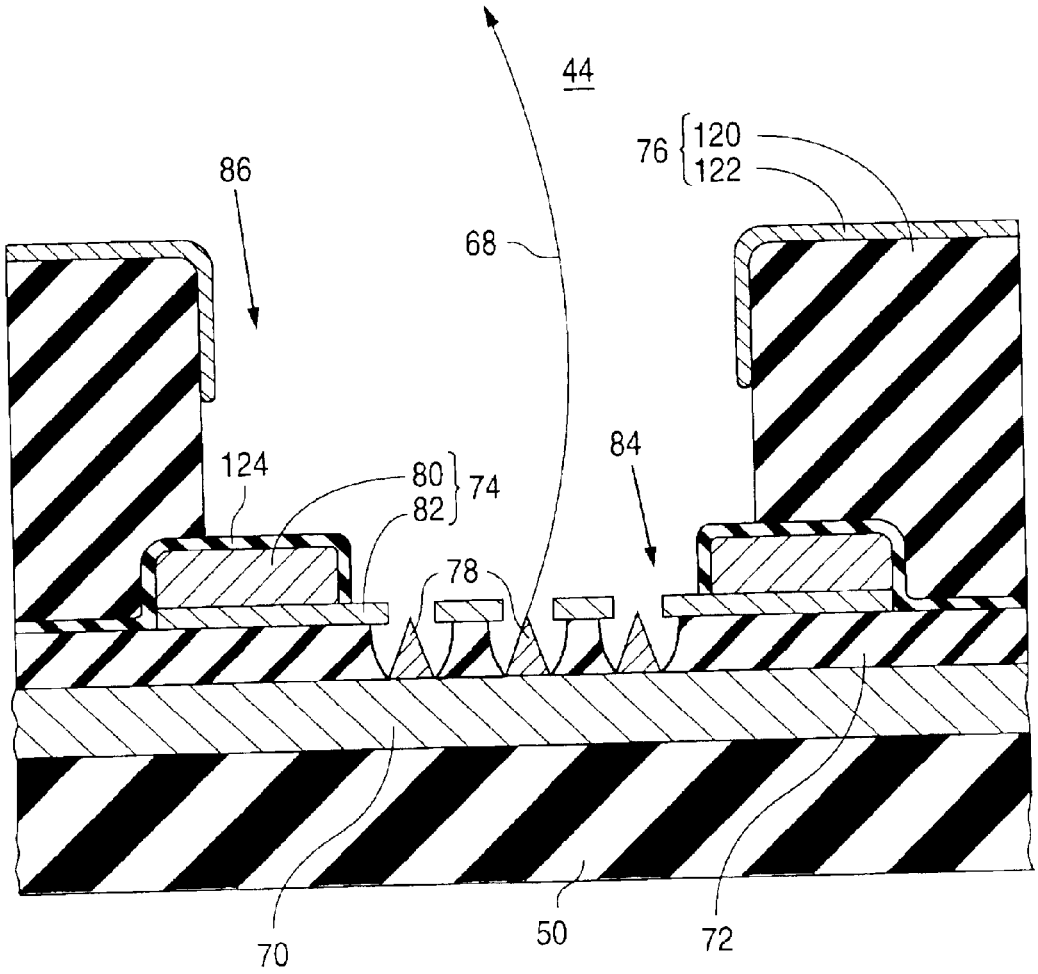
FIGS. 21 and 22 are cross-sectional side views of two general configurations of the electron-focusing system employed in the flat-panel displays of FIGS. 5, 6, and 9–20.

FIG. 21 illustrates an implementation of the internal structure of electron-focusing system 76. In this implementation, system 76 consists of a base focusing structure 120 and a focus coating 122. Base focusing structure 120 lies over dielectric layer 72 and extends over control electrodes 74. In the example of FIG. 21, structure 120 lies directly on an electrically insulating layer 124 which covers main control portions 80 of control electrode 74 and extends over dielectric layer 72 to the sides of main control portions 80. The lateral pattern for system 76 is established in structure 120.

Base focusing structure 120 consists of electrically non-conductive material, i.e., electrically insulating and/or electrically resistive material. FIG. 21 illustrates an example in which structure 120 is formed solely with insulating material. Structure 120 typically consists of polyimide. To the extent that structure 120 includes resistive material, structure 120 is configured and constituted so as to avoid interconnecting any of control electrodes 74.

Focus coating 122 lies on top of base focusing structure 120 and extends partway down the sidewalls of structure 120 into the focus openings such as focus opening 86 illustrated in FIG. 21. Focus coating 122 can extend substantially all the way down the sidewalls of structure 120 provided that coating 122 is electrically insulated from control electrodes 74. Coating 122 consists of electrically non-insulating material, normally electrically conductive material such as metal. In any event, coating 120 is of lower average electrically resistivity, normally considerably lower average electrically resistivity, than structure 120. The focus potential is provided to coating 122.

Each focus opening is laterally separated from each other focus opening by at least the material of focus coating 122. Normally, the material of base focusing structure 120 also laterally separates each focus opening from each other focus opening. Nonetheless, electron-focusing system 76 can be configured so that certain of the focus openings extend through coating 122 at laterally separated locations but are connected together in structure 120. Since coating 122 carries the focus potential which, in combination with the spacing between each focus opening and corresponding electron-emissive region 54 or electron-emissive portion 54A, 54B, 54C, 54D, 54E, or 54F, determines the electron focusing, the interconnection of focus openings in structure 120 is not significant to the present invention.

Figure 22:
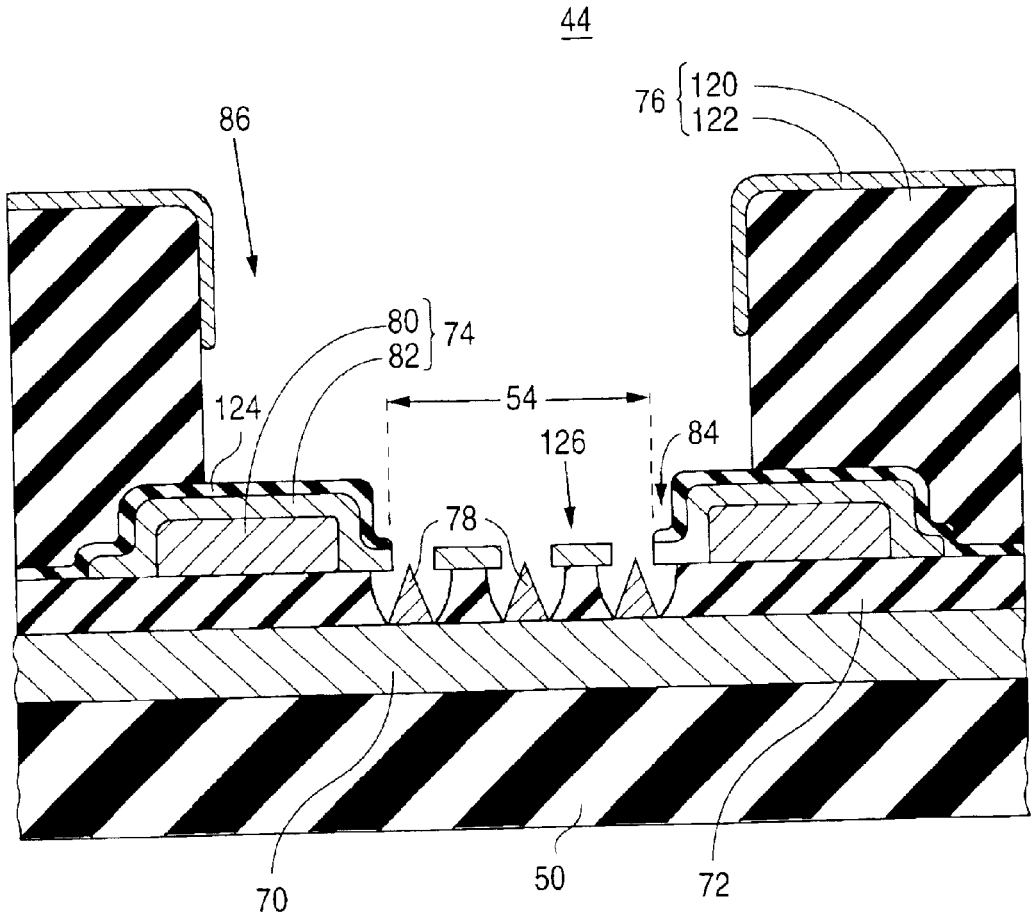

FIG. 22 depicts a variation of the structure of FIG. 21. Electron-focusing system 76 is configured substantially the same in this variation as in the structure of FIG. 21. However, gate portion 82 of illustrated control electrode 74 extends below adjoining main control portion 80 in FIG. 22 rather than above portion 80 as occurs in FIGS. 5, 9, 11, 13, 15, and 21. Also, the size, lateral shape, and orientation of each electron-emissive region 54 in the variation of FIG. 22 is defined by an opening 126 through insulating layer 124 rather than by control opening 84.

Each of the present flat-panel CRT displays is fabricated in generally the following manner. Light-emitting device 42 is fabricated separately from electron-emitting device 40, 100, 110, or 112. When spacer walls 46 are employed in the flat-panel display, they are mounted on device 42 or on device 40, 100, 110, or 112. Device 42 is hermetically sealed through the above-mentioned outer wall in such a way that the assembled, sealed display is at a very low internal pressure, typically no more than approximately $10^{-6}$ torr.

The fabrication of electron-emitting device 40, 100, 110, or 112 involves forming lower non-insulating region 70 on backplate 50. In so doing, the resistive layer is formed over emitter electrodes 104. Dielectric layer 72 is then deposited on top of the resultant structure. Control electrodes 74, electron-emissive elements 54, and (when present) insulating layer 124 are subsequently formed according to any of a number of process sequences. Base focusing structure 120 is formed on top of the structure in the desired pattern for electron-focusing system 76. Finally, focus coating 122 is deposited on structure 120. Getter material (not shown) may be provided at various locations in device 40, 100, 110, or 112.

Fabrication of light-emitting device 42 involves forming black matrix 66 on faceplate 60. Light-emissive material, typically phosphor, is then introduced into the openings in matrix 66 to create light-emissive region 64. Light-reflective anode layer 88 is subsequently deposited on top of regions 64 and matrix 66. Getter material may be provided at various locations in device 42.

Directional terms such as "lateral", "above", and "below" have been employed in describing the present invention to establish a frame of reference by which the reader can more easily understand how the various parts of the invention fit together. In actual practice, the components of a flat-panel CRT display may be situated at orientations different from that implied by the directional terms used here. Inasmuch as directional terms are used for convenience to facilitate the description, the invention encompasses implementations in which the orientations differ from those strictly covered by the directional terms employed here.

The terms "row" and "column" are arbitrary relative to each other and can be reversed. Also, taking note of the fact that lines of an image are typically generated in what is now termed the row direction, control electrodes 74 and emitter electrodes 104 of lower non-insulating region 70 can be rotated one-quarter turn so that control electrodes 74 extend in what is now termed the row direction while emitter electrodes 104 extend in what is now termed the column direction.

While the invention has been described with reference to particular embodiments, this description is solely for the purpose of illustration and is not to be construed as limiting the scope of the invention claimed below. The spacer system can have spacers of shapes other than relatively flat walls. Examples include posts and combinations of flat walls such as crosses and, as viewed vertically, patterns in the shape of an "L", a "T", or an "H".Field emission includes the phenomenon generally termed surface conduction emission.

Electron-focusing system 76 extends a significant distance above electron-emissive regions 54 in the examples presented above such that each focus opening 86 is located substantially fully above its region 54. Alternatively, system 76 can be configured to be in nearly the same plane as regions 54. In that case, each opening 86 may only partially overlie associated region 54. Electrons emitted by that region 54 then pass through only part of associated opening 76. The same applies to how focus openings 86A–86F are respectively situated relative to electron-emissive portions 54A–54F. Various modifications and applications may thus be made by those skilled in the art without departing from the true scope and spirit of the invention as defined in the appended claims.

I claim:

1. A flat-panel display for producing an image, the display comprising:

an electron-emitting device comprising (a) at least three laterally separated electron-emissive regions arranged in a line extending generally in a main direction, each pair of consecutive electron-emissive regions being at a center-to-center spacing which is at least 3% greater in the main direction for one pair of consecutive electron-emissive regions than for another pair of consecutive electron-emissive regions, and (b) a set of control electrodes for selectively extracting electrons from the electron-emissive regions or for selectively preventing electrons emitted by the electron-emissive regions from passing the control electrodes;

a light-emitting device comprising at least three light-emissive regions arranged in a line extending generally in the main direction, each light-emissive region situated generally opposite a corresponding different one of the electron-emissive regions for emitting light to produce at least part of a dot of the image upon being struck by electrons emitted by the corresponding electron-emissive regions; and an electron-focusing system, independent of the control electrodes, for focusing electrons emitted by each electron-emissive region toward the corresponding light-emissive region, the electron-focusing system having at least three focus openings arranged in a line extending generally in the main direction, each focus opening located at least partially above a corresponding different one of the electron-emissive regions so that electrons emitted by each electron-emissive region pass at least partially through the corresponding focus opening.

2. A display as in claim 1 further including a spacer situated between the electron-emitting and light-emitting devices above the space between the electron-emissive regions of one pair of consecutive electron-emissive regions whose center-to-center spacing is at least 3% greater in the main direction than that of another pair of consecutive electron-emissive regions.

3. A display as in claim 2 wherein the spacer comprises a spacer wall.

4. A display as in claim 1 wherein each pair of consecutive light-emissive regions is at a center-to-center spacing which is approximately the same in the main direction for every pair of consecutive light-emissive regions.

5. A display as in claim 1 wherein each focus opening extends substantially fully over the corresponding electron-emissive region.

6. A display as in claim 1 wherein one of the electron-emissive regions and the corresponding focus opening are at a non-zero center-to-center spacing in the main direction.

7. A display as in claim 1 wherein each electron-emissive region comprises at least two electron-emissive portions laterally separated in the main direction.

8. A display as in claim 7 wherein the electron-focusing system has at least three more focus openings arranged in the line extending generally in the main direction, each focus opening located at least partially above a different corresponding one of the electron-emissive portions so that electrons emitted by each electron-emissive portion pass at least partially through the corresponding focus opening.

9. A display as in claim 7 wherein one of the electron-emissive portions and the corresponding focus opening are at a non-zero center-to-center spacing in the main direction.

10. A display as in claim 1 wherein the center-to-center spacing of each pair of consecutive electron-emissive regions is at least 5% greater in the main direction for one pair of consecutive electron-emissive regions than for another pair of consecutive electron-emissive regions.

11. A display as in claim 1 wherein the center-to-center spacing of each pair of consecutive electron-emissive regions is at least 10% greater in the main direction for one pair of consecutive electron-emissive regions than for another pair of consecutive electron-emissive regions.

12. A display as in claim 1 wherein the pairs of consecutive electron-emissive regions are allocated into first pairs and second pairs that alternate with the first pairs, each second pair of consecutive electron-emissive regions being at a greater center-to-center spacing in the main direction than each first pair of consecutive electron-emissive regions.

13. A display as in claim 12 further including a spacer situated between the electron-emitting and light-emitting devices above space between the electron-emissive regions of one of the second pairs of consecutive electron-emissive regions.

14. A display as in claim 13 wherein the spacer comprises a spacer wall.

15. A display as in claim 12 wherein each pair of consecutive light-emissive regions is at a center-to-center spacing which is approximately the same in the main direction for every pair of consecutive light-emissive regions.

16. A display as in claim 12 wherein:

the center-to-center spacings of all the first pairs of consecutive electron-emissive regions are approximately the same; and the center-to-center spacings of all the second pairs of consecutive electron-emissive regions are approximately the same.

17. A display as in claim 16 further including a spacer situated between the electron-emitting and light-emitting devices above space between the electron-emissive regions of one of the second pairs of consecutive electron-emissive regions.

18. A display as in claim 16 wherein each pair of consecutive light-emissive regions is at a center-to-center spacing which is approximately the same in the main direction for every pair of consecutive light-emissive regions.

19. A display as in claim 16 wherein each electron-emissive region and the corresponding focus opening are at a non-zero center-to-center spacing in the main direction.

20. A display as in claim 16 wherein:

each first pair of consecutive electron-emissive regions are at a lesser center-to-center spacing in the main direction than the pair of focus openings situated respectively above that first pair of consecutive electron-emissive regions; and each second pair of consecutive electron-emissive regions are at a greater center-to-center spacing in the main direction than the pair of focus openings situated respectively above that second pair of consecutive electron-emissive regions.

21. A display as in claim 12 wherein each electron-emissive region comprises at least two electron-emissive portions laterally separated in the main direction.

22. A display as in claim 21 wherein the electron-focusing system has at least three more focus openings arranged in the line extending generally in the main direction, each focus opening located at least partially above a different corresponding one of the electron-emissive portions so that electrons emitted by each electron-emissive portion pass at least partially through the corresponding focus opening.

23. A display as in claim 22 wherein:

the electron-emissive portions of each electron-emissive region have a composite center;

the focus openings situated respectively above the electron-emissive portions of each electron-emissive region have a composite center; and the composite center of the electron-emissive portions of each electron-emissive region is laterally separated in the main direction from the composite center of the focus openings situated respectively above the electron-emissive portions of the corresponding electron-emissive region.

24. A display as in claim 23 wherein:

the composite centers of the electron-emissive portions of each first pair of consecutive electron-emissive regions are at a lesser separation in the main direction than the composite centers of the focus openings situated respectively above the electron-emissive portions of that first pair of electron-emissive regions; and the composite centers of the electron-emissive portions of each second pair of consecutive electron-emissive regions are at a greater separation in the main direction than the composite centers of the focus openings situated respectively above the electron-emissive portions of that second pair of consecutive electron-emissive regions.

25. A display as in claim 12 wherein the center-to-center spacing of each second pair of consecutive electron-emissive regions is at least 3% greater in the main direction than the center-to-center spacing of each first pair of consecutive electron-emissive regions.

26. A display as in claim 12 wherein the center-to-center spacing of each second pair of consecutive electron-emissive regions is at least 5% greater in the main direction than the center-to-center spacing of each first pair of consecutive electron-emissive regions.

27. A flat-panel display for producing an image, the display comprising:

an electron-emitting device comprising (a) an electron-emissive region comprising a pair of laterally separated primary electron-emissive portions for emitting electrons, (b) a control electrode for selectively extracting electrons from the electron-emissive portions or for selectively preventing electrons emitted by the electron-emissive portions from passing the control electrode, and (c) an electron-focusing system, independent of the control electrode, for focusing electrons emitted by the electron-emissive portions, the electron-focusing system having a pair of primary focus openings located respectively at least partially above the electron-emissive portions so that electrons emitted by the electron-emissive portions pass respectively at least partially through the focus openings, the two electron-emissive portions being at a greater lateral center-to-center spacing than the two focus openings; and a light-emitting device comprising a light-emissive region situated opposite the electron-emissive region for emitting light to produce at least part of a dot of the image upon being struck by electrons emitted by the electron-emissive portions.

28. A display as in claim 27 wherein the focus openings respectively extend substantially fully over the electron-emissive portions.

29. A display as in claim 27 wherein each electron-emissive portion and the focus opening located above the other electron-emissive portion are at a greater lateral center-to-center spacing than the two focus openings.

30. A display as in claim 27 wherein the electron-emissive portions are electrically coupled together so as to emit electrons substantially simultaneously.

31. A display as in claim 27 wherein the electron-focusing system comprises a base focusing structure and a focus coating overlying the base focusing structure, the focus coating being of lower average electrical resistivity than the base focusing structure, the focus openings extending through the focus coating at laterally separated locations.

32. A display as in claim 27 wherein:

the base-focusing structure comprises electrically non-conductive material; and the focus coating comprises electrically non-insulating material.

33. A display as in 28 wherein:

the electron-emissive region further includes a pair of additional electron-emissive portions for emitting electrons, the additional electron-emissive portions being laterally separated from each other and from the primary electron-emissive portions, the control electrode also selectively extracting electrons from the additional electron-emissive portions or selectively preventing electrons emitted by the additional electron-emissive portions from passing the control electrode; and the electron-focusing system has a pair of additional focus openings located respectively above the additional electron-emissive portions so that electrons emitted by the additional electron-emissive portions pass respectively through the additional focus openings, the two additional electron-emissive portions being at a greater lateral center-to-center spacing than the two additional focus openings.

34. A display as in claim 33 wherein the electron-emissive portions are configured in a two-by-two array in which the primary electron-emissive portions are situated in a first line and in which the additional electron-emissive portions are situated in a second line extending generally parallel to the first line.

35. A flat-panel display for producing an image, the display comprising:

an electron-emitting device characterized by a principal direction, the electron-emitting device comprising (a) a group of laterally separated electron-emissive regions for selectively emitting electrons, each electron-emissive region comprising a pair of primary electron-emissive portions laterally separated from each other in the principal direction, (b) a set of control electrodes for selectively extracting electrons from the electron-emissive portions or for selectively preventing electrons emitted by the electron-emissive portions from passing the control electrodes, and (c) an electron-focusing system independent of the control electrodes, the electron-focusing system having a group of pairs of primary focus openings, the focus openings in each focus-opening pair located respectively at least partially above the electron-emissive portions of a corresponding different one of the electron-emissive regions so that the electrons emitted by the electron-emissive portions of each electron-emissive region pass respectively at least partially through the focus openings of the corresponding focus-opening pair, the two electron-emissive portions of each electron-emissive region being at a greater center-to-center spacing in the principal direction than the two focus openings of the corresponding focus-opening pair; and a light-emitting device comprising an array of laterally separated light-emissive regions, each situated opposite a corresponding different one of the electron-emissive regions for emitting light to produce at least part of a different dot of the image upon being struck by electrons emitted from the electron-emissive portions of the corresponding electron-emissive region.

36. A display as in claim 35 wherein the focus openings in each focus-opening pair respectively extend substantially fully over the electron-emissive portions of the corresponding electron-emissive region.

37. A display as in claim 35 wherein each electron-emissive portion of each electron-emissive region and the focus opening overlying the other electron-emissive portion of that electron-emissive region are at a greater center-to-center spacing than the two focus openings respectively overlying the two electron-emissive portions of that electron-emissive region.

38. A display as in claim 35 wherein the electron-focusing system comprises a base focusing structure and a focus coating overlying the base focusing structure, the focus coating being of lower average electrical resistivity than the base focusing structure, the focus openings extending through the focus coating at laterally separated locations.

39. A display as in claim 35 wherein:

each electron-emissive region further includes a pair of additional electron-emissive portions laterally separated from each other in the principal direction and laterally separated from the primary electron-emissive portions of that electron-emissive region in a further direction generally perpendicular to the principal direction, the control electrodes also selectively extracting electrons from the additional electron-emissive portions or selectively preventing electrons emitted by the additional electron-emissive portions from passing the control electrodes; and the electron-focusing system further has a plurality of pairs of additional focus openings, the additional focus openings in each additional focus-opening pair located respectively at least partially above the additional electron-emissive portions of a corresponding different one of the electron-emissive regions so that the electrons emitted by the additional electron-emissive portions of each electron-emissive region pass respectively at least partially through the additional focus openings of the corresponding additional focus-opening pair, the additional electron-emissive portions of each electron-emissive region being at a greater center-to-center spacing than the additional focus openings of the corresponding additional focus-opening pair.

40. A display as in claim 35 wherein the electron-emissive regions are arranged in a line extending generally in a further direction different from the principal direction, each pair of consecutive electron-emissive regions being at a center-to-center spacing which is at least 3% greater in the further direction for one of the pairs of consecutive electron-emissive regions than for another of the pairs of consecutive electron-emissive regions.

41. A display as in claim 40 wherein the pairs of consecutive electron-emissive regions are allocated into first pairs and second pairs that alternate with the first pairs, the second pairs of consecutive electron-emissive regions being at a greater center-to-center spacing in the further direction than each first pair of consecutive electron-emissive regions.

42. A display as in claim 41 further including a spacer situated between the electron-emitting and light-emitting devices above the electron-focusing system at a location above space between one of the second pairs of consecutive electron-emissive regions.

43. A display as in claim 42 wherein the spacer comprises a spacer wall.

44. A display as in claim 41 wherein:

the center-to-center spacings of all the first pairs of consecutive electron-emissive regions are approximately the same; and the center-to-center spacings of all the second pairs of consecutive electron-emissive regions are approximately the same.

45. A display as in claim 41 wherein each electron-emissive portion and the focus opening above that electron-emissive portion are at a non-zero center-to-center spacing in the further direction.

46. A display as in claim 41 wherein:

the four electron-emissive portions of each first pair of consecutive electron-emissive regions are at a lesser center-to-center spacing in the further direction than the four focus openings above that first pair of consecutive electron-emissive regions; and the four electron-emissive portions of each second pair of consecutive electron-emissive regions are at a greater center-to-center spacing in the further direction than the four focus openings above that second pair of electron-emissive regions.

47. A display as in claim 41 wherein:

each electron-emissive region further includes a pair of additional electron-emissive portions laterally separated from each other in the principal direction and laterally separated from the primary electron-emissive portions of that electron-emissive region in the further direction, the control electrodes also selectively extracting electrons from the additional electron-emissive portions or selectively preventing electrons emitted by the additional electron-emissive portions from passing the control electrodes; and the electron-focusing system further has a plurality of pairs of additional focus openings, the additional focus openings in each additional focus-opening pair located respectively at least partially above the additional electron-emissive portions of a corresponding different one of the electron-emissive regions so that electrons emitted by the additional electron-emissive portions of each electron-emissive region pass respectively at least partially through the additional focus openings of the corresponding additional focus-opening pair, the additional electron-emissive portions of each electron-emissive region being at a greater center-to-center spacing than the additional focus openings of the corresponding additional focus-opening pair.

48. A display as in claim 47 wherein:

the electron-emissive portions of each electron-emissive region have a composite center;

the focus openings situated respectively above the electron-emissive portions of each electron-emissive region have a composite center; and the composite center of the electron-emissive portions of each electron-emissive region is laterally separated in the further direction from the composite center of the focus openings situated respectively above the electron-emissive portions of the corresponding electron-emissive region.

49. A display as in claim 48 wherein:

the composite centers of the electron-emissive portions of each first pair of consecutive electron-emissive regions are at a lesser separation in the further direction than the composite centers of the focus openings situated respectively above the electron-emissive portions of that first pair of electron-emissive regions; and the composite centers of the electron-emissive portions of each second pair of consecutive electron-emissive regions are at a greater separation in the further direction than the composite centers of the focus openings situated respectively above the electron-emissive portions of that second pair of consecutive electron-emissive regions.

50. A display as in claim 40 the center-to-center spacing of each pair of consecutive electron-emissive regions is at least 5% greater in the further direction for one pair of consecutive electron-emissive regions than for another pair of consecutive electron-emissive regions.

51. A display as in claim 7 wherein the electron-emissive portions of each electron-emissive region are electrically coupled together so as to emit electrons substantially simultaneously.

52. A display as in claim 1 wherein the electron-focusing system contacts the electron-emitting device.

53. A display as in claim 21 wherein the electron-emissive portions of each electron-emissive region are electrically coupled together so as to emit electrons substantially simultaneously.

54. A display as in claim 12 wherein the electron-focusing system contacts the electron-emitting device.

55. A flat-panel display for producing an image, the display comprising:

an electron-emitting device comprising at least three laterally separated electron-emissive regions arranged in a line extending generally in a main direction, the electron-emissive regions being allocated into first and second pairs of consecutive electron-emissive regions where the second pairs alternate with the first pairs, each second pair of consecutive electron-emissive regions being at a greater center-to-center spacing in the main direction than each first pair of consecutive electron-emissive regions;

a light-emitting device comprising at least three light-emissive regions arranged in a line extending generally in the main direction, each light-emissive region situated generally opposite a corresponding different one of the electron-emissive regions for emitting light to produce at least part of a dot of the image upon being struck by electrons emitted by the corresponding electron-emissive region; and an electron-focusing system for focusing electrons emitted by each electron-emissive region toward the corresponding light-emissive region.

56. A display as in claim 55 further including a spacer situated between the electron-emitting and light-emitting devices above space between the electron-emissive regions of one of the second pairs of consecutive electron-emissive regions.

57. A display as in claim 56 wherein the spacer comprises a spacer wall.

58. A display as in claim 55 wherein each pair of consecutive light-emissive regions is at a center-to-center spacing which is approximately the same in the main direction for every pair of consecutive light-emissive regions.

59. A display as in claim 55 wherein:

the center-to-center spacings of all the first pairs of consecutive electron-emissive regions are approximately the same; and the center-to-center spacings of all the second pairs of consecutive electron-emissive regions are approximately the same.

60. A display as in claim 55 wherein the center-to-center spacing of each second pair of consecutive electron-emissive regions is at least 3% greater in the main direction than the center-to-center spacing of each first pair of consecutive electron-emissive regions.

61. A display as in claim 55 wherein the center-to-center spacing of each second pair of consecutive electron-emissive regions is at least 5% greater in the main direction than the center-to-center spacing of each first pair of consecutive electron-emissive regions.

62. A display as in claim 55 wherein the center-to-center spacing of each second pair of consecutive electron-emissive regions is at least 10% greater in the main direction than the center-to-center spacing of each first pair of consecutive electron-emissive regions.

63. A display as in claim 55 wherein each electron-emissive region comprises at least two electron-emissive portions laterally separated in the main direction.

64. A display as in claim 63 wherein the electron-emissive portions of each electron-emissive region are electrically coupled together so as to emit electrons substantially simultaneously.

65. A display as in claim 55 wherein the electron-focusing system contacts the electron-emitting device.

66. A display as in claim 55 wherein the electron-emitting device further includes a set of control electrodes for selectively extracting electrons from the electron-emissive regions or for selectively preventing electrons emitted by the electron-emissive regions from passing the control electrodes, the electron-focusing system being independent of the control electrodes.

* * * * *